US009970251B2

(12) United States Patent
Turley et al.

(10) Patent No.: US 9,970,251 B2
(45) **Date of Patent: *May 15, 2018**

(54) TELEMETRY OPERATED SETTING TOOL

(71) Applicant: Weatherford Technology Holdings, LLC, Houston, TX (US)

(72) Inventors: Rocky A. Turley, Houston, TX (US); Robin L. Campbell, Webster, TX (US); Karsten Heidecke, Houston, TX (US); George Givens, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/212,817

(22) Filed: Jul. 18, 2016

(65) Prior Publication Data

US 2016/0326819 A1 Nov. 10, 2016

Related U.S. Application Data

(63) Continuation of application No. 14/082,978, filed on Nov. 18, 2013, now Pat. No. 9,428,998.

(51) Int. Cl.
*E21B 23/01* (2006.01)
*E21B 47/14* (2006.01)
(Continued)

(52) U.S. Cl.
CPC ..... *E21B 23/01* (2013.01); *E21B 23/00* (2013.01); *E21B 33/12* (2013.01); *E21B 33/13* (2013.01);
(Continued)

(58) Field of Classification Search
CPC ..... E21B 47/14; E21B 43/10; E21B 23/00; E21B 33/12; E21B 33/13; E21B 43/103
See application file for complete search history.

(56) References Cited

U.S. PATENT DOCUMENTS 4,405,017 A 9/1983 Allen et al.
4,583,593 A 4/1986 Zunkel et al.
(Continued)

FOREIGN PATENT DOCUMENTS

GB 2350141 A 11/2000
WO 2012/065126 A2 5/2012

OTHER PUBLICATIONS

Canadian Office Action dated Mar. 31, 2017, for Canadian Patent Application No. 2,869,261.
(Continued)

*Primary Examiner* — Brad Harcourt
(74) *Attorney, Agent, or Firm* — Patterson & Sheridan, LLP

(57) ABSTRACT

A setting tool for hanging a tubular string includes: a mandrel having an upper portion and a lower portion for extending into the tubular string; a housing connected to the mandrel upper portion; and a bonnet. The bonnet is: for receiving an upper end of the tubular string, disposed along the mandrel, and linked to the housing. The setting tool further includes: an actuator for stroking the bonnet relative to the mandrel and the housing, thereby setting a hanger of the tubular string; an electronics package in communication with the actuator for operating the actuator in response to receiving a command signal; and a latch. The latch is: connected to the mandrel lower portion, operable between an extended position and a retracted position, for being restrained in the retracted position by being disposed in the tubular string, and extendable by being removed from the tubular string.

20 Claims, 10 Drawing Sheets

(51) Int. Cl.

| | |
|---|---|
| ***E21B 33/12*** | (2006.01) |
| ***E21B 23/00*** | (2006.01) |
| ***E21B 33/13*** | (2006.01) |
| ***E21B 43/10*** | (2006.01) |
| ***E21B 33/14*** | (2006.01) |
| ***E21B 34/10*** | (2006.01) |
| *E21B 34/00* | (2006.01) |

(52) U.S. Cl.
CPC ..... *E21B 33/14* (2013.01); *E21B 34/10* (2013.01); *E21B 43/10* (2013.01); *E21B 47/14* (2013.01); *E21B 2034/005* (2013.01); *E21B 2034/007* (2013.01)

(56) References Cited

U.S. PATENT DOCUMENTS

| | | | |
|---|---|---|---|
| 4,893,678 | A | 1/1990 | Stokley et al. |
| 5,086,843 | A | 2/1992 | Mims et al. |
| 5,086,844 | A | 2/1992 | Mims et al. |
| 5,146,992 | A | 9/1992 | Baugh |
| 5,170,847 | A | 12/1992 | Mims et al. |
| 5,174,375 | A | 12/1992 | Mims et al. |
| 5,360,069 | A | 11/1994 | Schmuck et al. |
| 5,435,390 | A | 7/1995 | Baugh et al. |
| 5,553,667 | A | 9/1996 | Budde et al. |
| 5,560,426 | A | 10/1996 | Trahan et al. |
| 5,590,713 | A | 1/1997 | Baugh et al. |
| 5,787,979 | A | 8/1998 | Giroux et al. |
| 5,813,457 | A | 9/1998 | Giroux et al. |
| 5,833,002 | A | 11/1998 | Holcombe |
| 5,856,790 | A | 1/1999 | Baugh et al. |
| 5,954,133 | A | 9/1999 | Ross |
| 6,009,944 | A | 1/2000 | Gudmestad |
| 6,053,244 | A | 4/2000 | Dybevik et al. |
| 6,056,053 | A | 5/2000 | Giroux et al. |
| 6,065,536 | A | 5/2000 | Gudmestad et al. |
| 6,241,018 | B1 | 6/2001 | Eriksen |
| 6,241,023 | B1 | 6/2001 | Krauss et al. |
| 6,244,350 | B1 | 6/2001 | Gudmestad et al. |
| 6,311,771 | B1 | 11/2001 | Gudmestad et al. |
| 6,318,472 | B1 | 11/2001 | Rogers et al. |
| 6,419,015 | B1 | 7/2002 | Budde et al. |
| 6,527,057 | B2 | 3/2003 | Fraser, III et al. |
| 6,561,270 | B1 | 5/2003 | Budde |
| 6,597,175 | B1 | 7/2003 | Brisco |
| 6,634,428 | B2 | 10/2003 | Krauss et al. |
| 6,789,619 | B2 | 9/2004 | Carlson et al. |
| 6,799,638 | B2 | 10/2004 | Butterfield, Jr. |
| 6,848,511 | B1 | 2/2005 | Jones et al. |
| 6,866,100 | B2 | 3/2005 | Gudmestad et al. |
| 6,966,368 | B2 | 11/2005 | Farquhar |
| 7,063,148 | B2 | 6/2006 | Jabusch |
| 7,066,256 | B2 | 6/2006 | Dillenbeck et al. |
| 7,114,573 | B2 | 10/2006 | Hirth et al. |
| 7,128,154 | B2 | 10/2006 | Giroux et al. |
| 7,165,622 | B2 | 1/2007 | Hirth et al. |
| 7,182,135 | B2 | 2/2007 | Szarka |
| 7,219,730 | B2 | 5/2007 | Tilton et al. |
| 7,252,152 | B2 | 8/2007 | LoGiudice et al. |
| 7,426,964 | B2 | 9/2008 | Lynde et al. |
| 7,537,060 | B2 | 5/2009 | Fay et al. |
| 7,581,595 | B2 | 9/2009 | Fay et al. |
| 7,584,792 | B2 | 9/2009 | Szarka |
| 7,686,092 | B2 | 3/2010 | Szarka |
| 7,766,088 | B2 | 8/2010 | Saucier et al. |
| 7,845,400 | B2 | 12/2010 | Smith, Jr. et al. |
| 8,276,665 | B2 | 10/2012 | Webb et al. |
| 8,286,717 | B2 | 10/2012 | Giroux et al. |
| 8,347,964 | B2 | 1/2013 | Fisher et al. |
| 8,479,808 | B2 | 7/2013 | Gouthaman |
| 8,651,174 | B2 | 2/2014 | Barbee et al. |
| 8,668,003 | B2 | 3/2014 | Osmundsen et al. |
| 8,881,824 | B2 | 11/2014 | Stautzenberger |
| 8,997,850 | B2 | 4/2015 | Barbee et al. |
| 9,004,179 | B2 | 4/2015 | Chauffe |
| 9,068,413 | B2 | 6/2015 | Doane |
| 9,068,414 | B2 | 6/2015 | Doane |
| 9,080,404 | B2 | 7/2015 | Kalb et al. |
| 9,121,232 | B2 | 9/2015 | Abraham et al. |
| 9,212,531 | B2 | 12/2015 | Robichaux et al. |
| 9,428,998 | B2 * | 8/2016 | Turley ..... E21B 43/10 |
| 2003/0230405 | A1 | 12/2003 | Allamon et al. |
| 2005/0006106 | A1 | 1/2005 | Hirth et al. |
| 2006/0124295 | A1 * | 6/2006 | Maguire ..... E21B 43/103 166/207 |
| 2007/0272413 | A1 | 11/2007 | Rytlewski et al. |
| 2009/0266544 | A1 | 10/2009 | Redlinger et al. |
| 2009/0272544 | A1 * | 11/2009 | Giroux ..... E21B 47/122 166/382 |
| 2010/0051264 | A1 | 3/2010 | Willauer |
| 2010/0181079 | A1 | 7/2010 | Johnson et al. |
| 2011/0000663 | A1 | 1/2011 | Brandsdal |
| 2012/0061100 | A1 | 3/2012 | Braeker |
| 2012/0067594 | A1 | 3/2012 | Noske et al. |
| 2013/0299196 | A1 | 11/2013 | Kolle |
| 2013/0327532 | A1 | 12/2013 | Ring et al. |
| 2014/0008083 | A1 | 1/2014 | Ring et al. |
| 2014/0138101 | A1 | 5/2014 | Arabsky et al. |
| 2014/0196912 | A1 | 7/2014 | Turley et al. |
| 2014/0262234 | A1 | 9/2014 | Walton et al. |
| 2015/0136394 | A1 | 5/2015 | Turley et al. |
| 2015/0136395 | A1 | 5/2015 | Turley et al. |
| 2015/0136396 | A1 | 5/2015 | Turley et al. |

OTHER PUBLICATIONS

Weatherford—WellMaster All-in-One Deepwater System brochure, date unknown, 1 page.
Weatherford—Liner Hanger Selection brochure, May 2006, 24 pages.
Weatherford—HNG Hydraulic-Release Running Tool brochure, 2006, 1 page.
Weatherford—Weatherford's Linear Systems—Hang Tough brochure, 2008-2012, 16 pages.
Weatherford—SwageSet Series Liner-Top Packer brochure, 2011-2013, 6 pages.
Canadian Patent Examination Report dated Jul. 4, 2016 for Canadian Application No. 2, 869, 261.
EPO Extended European Search Report dated Sep. 27, 2017, for European Application No. 17173136.7.

* cited by examiner

TELEMETRY OPERATED SETTING TOOL

BACKGROUND OF THE DISCLOSURE

Field of the Disclosure

The present disclosure generally relates to a telemetry operated setting tool.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

The liner string is typically deployed to a desired depth in the wellbore using a workstring. A setting tool of the liner string is then operated to set the liner hanger against a previously installed casing string. The setting tool is typically operated by pumping a ball through the workstring to a seat located below the setting tool. Pressure is exerted on the seated ball to operate the setting tool. Such a setting tool may limit operational flexibility in deploying the liner string as a pressure surge could unintentionally operate the setting tool before the liner string has reached the desired depth.

SUMMARY OF THE DISCLOSURE

The present disclosure generally relates to a telemetry operated setting tool. In one embodiment, a setting tool for hanging a tubular string from a liner string, casing string, or wellhead includes: a mandrel having an upper portion and a lower portion for extending into the tubular string; a housing connected to the mandrel upper portion; and a bonnet. The bonnet is: for receiving an upper end of the tubular string, disposed along the mandrel, and linked to the housing. The setting tool further includes: an actuator for stroking the bonnet relative to the mandrel and the housing, thereby setting a hanger of the tubular string; an electronics package in communication with the actuator for operating the actuator in response to receiving a command signal; and a latch. The latch is: connected to the mandrel lower portion, operable between an extended position and a retracted position, for being restrained in the retracted position by being disposed in the tubular string, and extendable by being removed from the tubular string.

In another embodiment, a method of hanging a tubular string from a liner string, casing string, or wellhead, includes running the tubular string into a wellbore using a deployment string and a deployment assembly. The deployment assembly includes a setting tool closing an upper end of the tubular string. The method further includes: sending a first command signal to the setting tool, thereby setting a hanger of the tubular string; after hanging the tubular string, raising the setting tool from the tubular string, thereby extending a latch of the setting tool against the upper end; and after raising the setting tool, setting weight on the latch and upper end, thereby setting a packer of the tubular string.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
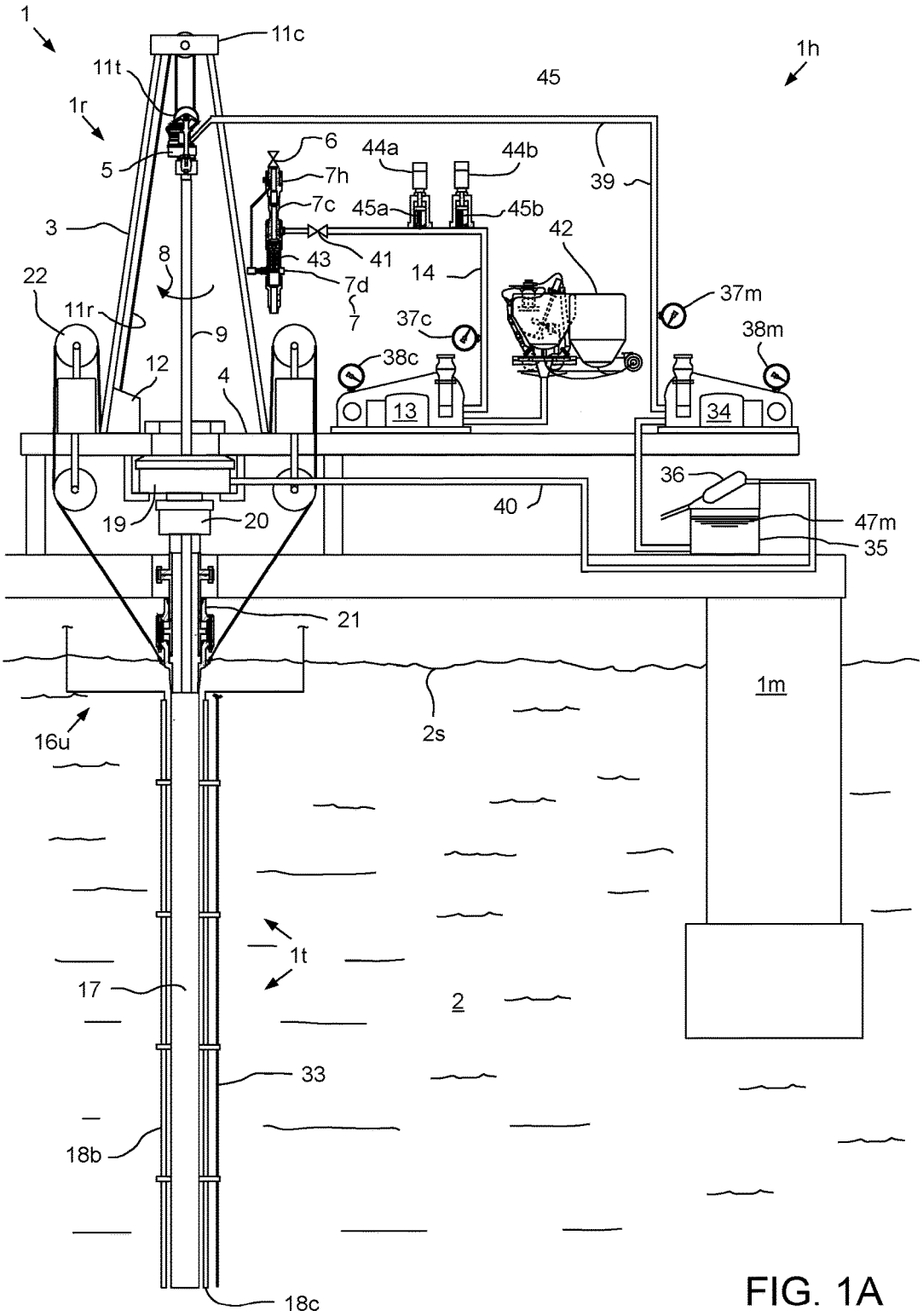
FIGS. 1A-1C illustrate a drilling system in a liner deployment mode, according to one embodiment of this disclosure.
Figure 1B:
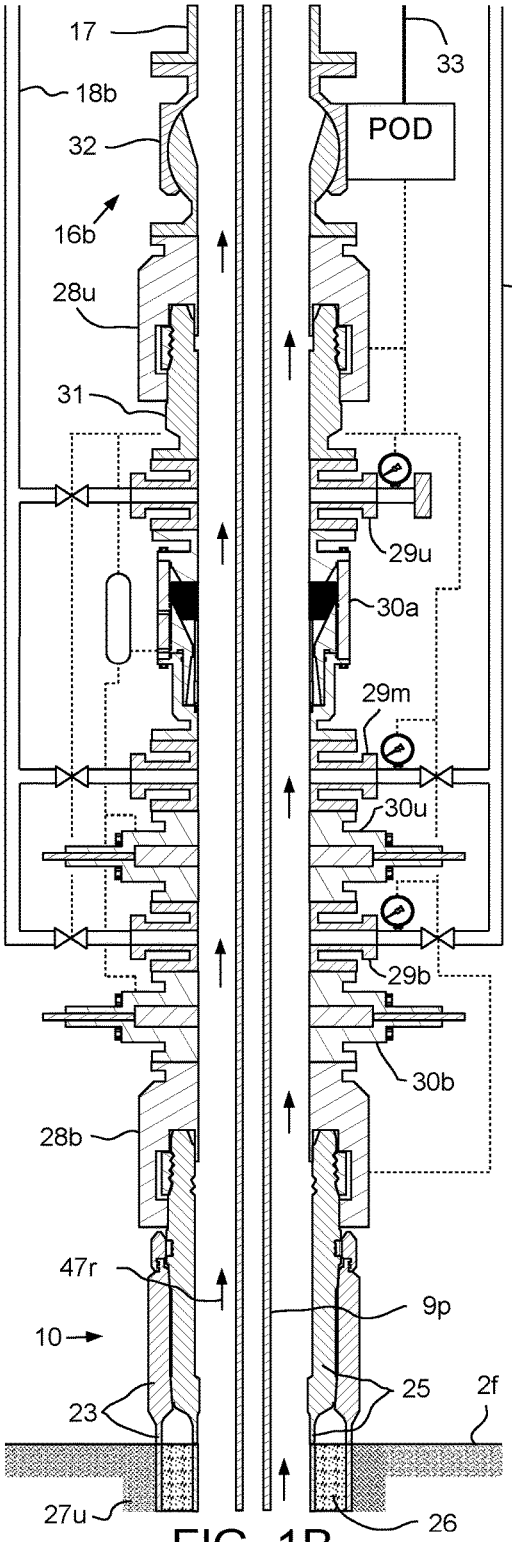
Figure 1C:
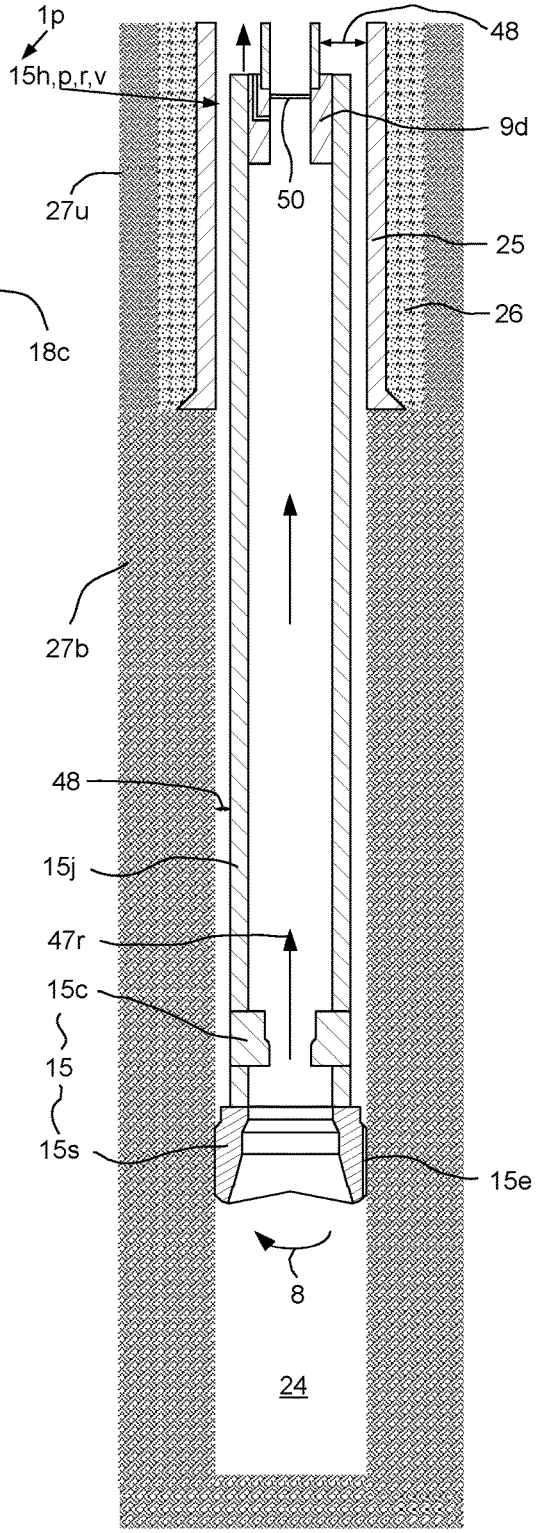

FIGS. 1A-1C illustrate a drilling system 1 in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* connected together, such as by threaded couplings. An upper end of the LDA 9*d* may be connected a lower end of the drill pipe 9*p*, such as by threaded couplings. The LDA 9*d* may also be connected to a liner string 15. The liner string 15 may include a setting sleeve 15*v*, a polished bore receptacle (PBR) 15*r*, a packer 15*p*, a liner hanger 15*h*, joints of liner 15*j*, a landing collar 15*c*, and a reamer shoe 15*s*. The PBR 15*r*, liner joints 15*j*, landing collar 15*c*, and reamer shoe 15*s* may be interconnected, such as by threaded couplings. The reamer shoe 15*s* may be rotated 8 by the top drive 5 via the workstring 9.

Alternatively, drilling fluid may be injected into the liner string 15 during deployment thereof. Alternatively, drilling fluid may be injected into the liner string 15 and the liner string may include a drillable drill bit (not shown) instead of the reamer shoe 15*s* and the liner string may be drilled into the lower formation 27*b*, thereby extending the wellbore 24 while deploying the liner string.

Once liner deployment has concluded, the workstring 9 may be disconnected from the top drive 5 and the cementing head 7 may be inserted and connected therebetween. The cementing head 7 may include an isolation valve 6, an actuator swivel 7*h*, a cementing swivel 7*c*, and a plug launcher, such as a dart launcher 7*d*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8 of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have two inlets in fluid communication with respective passages formed through the mandrel. The mandrel passages may extend to respective outlets of the mandrel for connection to respective hydraulic conduits (only one shown) for operating respective hydraulic actuators of the launcher 7*d*. The actuator swivel inlets may be in fluid communication with a hydraulic power unit (HPU, not shown).

Alternatively, the seal assembly may include rotary seals, such as mechanical face seals.

The dart launcher 7*d* may include a body, a diverter, a canister, a latch, and the actuator. The body may be tubular and may have a bore therethrough. To facilitate assembly, the body may include two or more sections connected together, such as by threaded couplings. An upper end of the body may be connected to a lower end of the actuator swivel, such as by threaded couplings and a lower end of the body may be connected to the workstring 9. The body may further have a landing shoulder formed in an inner surface thereof. The canister and diverter may each be disposed in the body bore. The diverter may be connected to the body, such as by threaded couplings. The canister may be longitudinally movable relative to the body. The canister may be tubular and have ribs formed along and around an outer surface thereof. Bypass passages may be formed between the ribs. The canister may further have a landing shoulder formed in a lower end thereof corresponding to the body landing shoulder. The diverter may be operable to deflect fluid received from a cement line 14 away from a bore of the canister and toward the bypass passages. A release plug, such as a dart 43, may be disposed in the canister bore.

The launcher latch may include a body, a plunger, and a shaft. The latch body may be connected to a lug formed in an outer surface of the launcher body, such as by threaded couplings. The plunger may be longitudinally movable relative to the latch body and radially movable relative to the launcher body between a capture position and a release position. The plunger may be moved between the positions by interaction, such as a jackscrew, with the shaft. The shaft may be longitudinally connected to and rotatable relative to the latch body. The actuator may be a hydraulic motor operable to rotate the shaft relative to the latch body.

Alternatively, the actuator swivel and launcher actuator may be pneumatic or electric. Alternatively, the launcher actuator may be linear, such a piston and cylinder.

In operation, when it is desired to launch the dart 43, the HPU may be operated to supply hydraulic fluid to the launcher actuator via the actuator swivel 7*h*. The launcher actuator may then move the plunger to the release position (not shown). The canister and dart 43 may then move downward relative to the housing until the landing shoulders engage. Engagement of the landing shoulders may close the canister bypass passages, thereby forcing fluid to flow into the canister bore. The fluid may then propel the dart 43 from the canister bore into a lower bore of the housing and onward through the workstring 9.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14, mud line 39, and return line 40, a cement mixer 42, and one or more tag launchers 44*a,b*. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The tag launcher 44, a shutoff valve 41, and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

Each tag launcher 44*a,b* may include a housing, a plunger, an actuator, and a magazine (not shown) having a plurality of respective wireless identification tags, such as radio frequency identification (RFID) tags, loaded therein. A chambered RFID tag 45*a,b* may be disposed in the respective plunger for selective release and pumping downhole to communicate with the LDA 9*d*. Each plunger may be movable relative to the respective launcher housing between a captured position and a release position. Each plunger may be moved between the positions by the respective actuator. The actuator may be hydraulic, such as a piston and cylinder assembly.

Alternatively, each actuator may be electric or pneumatic. Alternatively, each actuator may be manual, such as a handwheel. Alternatively, each tag 45*a,b* may be manually launched by breaking a connection in the respective line. Alternatively, each tag launcher may be part of the cementing head.

The workstring 9 may be rotated 8 by the top drive 5 and lowered by the traveling block 11*t*, thereby reaming the liner string 15 into the lower formation 27*b*. Drilling fluid in the wellbore 24 may be displaced through courses 15*e* of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the LDA 9*d*. The returns 47*r* may flow up the LDA bore and to a diverter valve 50 thereof. The returns 47*r* may be diverted into an annulus 48 formed between the workstring 9/liner string 15 and the casing string 25/wellbore 24 by the diverter valve 50. The returns 47*r* may exit the wellbore 24 and flow into an annulus formed between the riser 17 and the drill pipe 9*p* via an annulus of the LMRP 16*b*, BOP stack, and wellhead 10. The returns 47*r* may exit the riser annulus and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The setting sleeve 15*v*, packer 15*p*, and an upper portion of the liner hanger 15*h* may be longitudinally movable relative to the PBR 15*r* for setting of the packer and liner hanger. A lower end of the setting sleeve 15*v* may be connected to an upper end of the packer 15*p*, such as by threaded couplings. A lower end of the packer 15*p* may be linked to an upper end of the liner hanger 15*h* by a thrust bearing 15*b* to longitudinally connect a lower portion of the packer and the hanger upper portion in a downward direction while allowing relative rotation therebetween. The packer lower portion may also be linked to the PBR 15*r* by a pin and slot connection 15*n* to allow relative longitudinal movement therebetween while retaining a torsional connection.

A lower end of the liner hanger 15*h* may be fastened to the PBR 15*r*, such as by an emergency release connection 15*o* to longitudinally and torsionally connect the hanger lower portion to the PBR 15*r* unless an emergency release maneuver is performed. The emergency release connection 15*o* may include a pair of bayonet couplings connected together by a shearable fastener. An upper portion of the packer 15*p* may be linked to the PBR 15*r* by an upper ratchet connection 15*k* and a lower portion of the packer 15*p* may be linked to the PBR 15*r* by a lower ratchet connection 15*m*. Each ratchet connection 15*k,m* may include a ratchet and a profile of complementing teeth to allow downward movement of the respective packer portion relative to the PBR 15*r* while preventing upward movement of the respective packer portion relative to the PBR.

The hanger upper portion may initially be fastened to the PBR 15*r* by a shearable fastener 15*y* to prevent premature setting of the liner hanger 15*h*. The packer upper portion may also be linked to the PBR 15*r* by a releasable slip joint 15*w,x*. The slip joint 15*w,x* may allow downward movement of the packer upper portion relative to the PBR 15*r* until a stroke of the joint is reached at which the joint connects the packer upper portion to the PBR in the downward direction, thereby preventing premature setting of the packer 15*p*. The slip joint 15*w,x* may include a sleeve 15*w* disposed in an annular space formed between the packer upper portion and the PBR 15*r* and fastened to the packer upper portion by one or more (two shown) shearable fasteners 15*x*. The space may be longitudinally formed between upper and lower shoulders of the PBR 15*r*. A bottom of the sleeve 15*w* may be spaced from the PBR lower shoulder by the stroke length of the connection 15*w,x*. The slip joint 15*w,x* is stroked when the sleeve bottom engages the PBR lower shoulder and the joint may be released by a threshold force on the packer upper portion to fracture the shearable fasteners 15*x*. The slip joint stroke length may correspond to a setting length of the liner hanger 15*h*, such as being slightly greater than.

The LDA 9*d* may include the diverter valve 50 (shown only in FIG. 1C), a junk bonnet 51, a setting tool 52, a running tool 53, a stinger 54, and a plug release system 58. An upper end of the diverter valve 50 may be connected to a lower end the drill pipe 9*p* and a lower end of the diverter valve 50 may be connected to an upper end of the setting tool 52, such as by threaded couplings. A lower end of the setting tool 52 may be fastened to an upper end of the running tool 53. The running tool 53 may also be fastened to the PBR 15*r*. An upper end of the stinger 54 may be connected to a lower end of the running tool 53 and a lower end of the stringer may be connected to the plug release system 58, such as by threaded couplings.

The diverter valve 50 may include a housing, a bore valve, and a port valve. The diverter housing may include two or more tubular sections (three shown) connected to each other, such as by threaded couplings. The diverter housing may have threaded couplings formed at each longitudinal end thereof for connection to the drill pipe 9*p* at an upper end thereof and the junk bonnet 51 at a lower end thereof. The bore valve may be disposed in the housing. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. Although not shown, the body may have a fill orifice formed through a wall thereof and bypassing the flapper.

The diverter port valve may include a sleeve and a biasing member, such as a compression spring. The sleeve may include two or more sections connected to each other, such as by threaded couplings and/or fasteners. An upper section of the sleeve may be connected to a lower end of the bore valve body, such as by threaded couplings. Various interfaces between the sleeve and the housing and between the housing sections may be isolated by seals. The sleeve may be disposed in the housing and longitudinally movable relative thereto between an upper position and a lower position. The sleeve may be stopped in the lower position against an upper end of the lower housing section and in the upper position by the bore valve body engaging a lower end of the upper housing section. The mid housing section may have one or more flow ports and one or more equalization ports formed through a wall thereof. One of the sleeve sections may have one or more equalization slots formed therethrough providing fluid communication between a spring chamber formed in an inner surface of the mid housing section and the lower bore portion of the diverter valve 50.

One of the diverter sleeve sections may cover the housing flow ports when the sleeve is in the lower position, thereby closing the housing flow ports and the sleeve section may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

The junk bonnet 51 may be engaged with and close an upper end of the setting sleeve 15*v*, thereby forming an upper end of a buffer chamber 59. A lower end of the buffer chamber 59 may be formed by a sealed interface between the plug release system 58 and the PBR 15*r*. The buffer chamber 59 may be filled with a hydraulic fluid (not shown), such as fresh water or refined/synthetic oil. The buffer chamber 59 may prevent infiltration of debris from the wellbore 24 from obstructing operation of the LDA 9*d*.

Figures 3A, 3B, 3C:
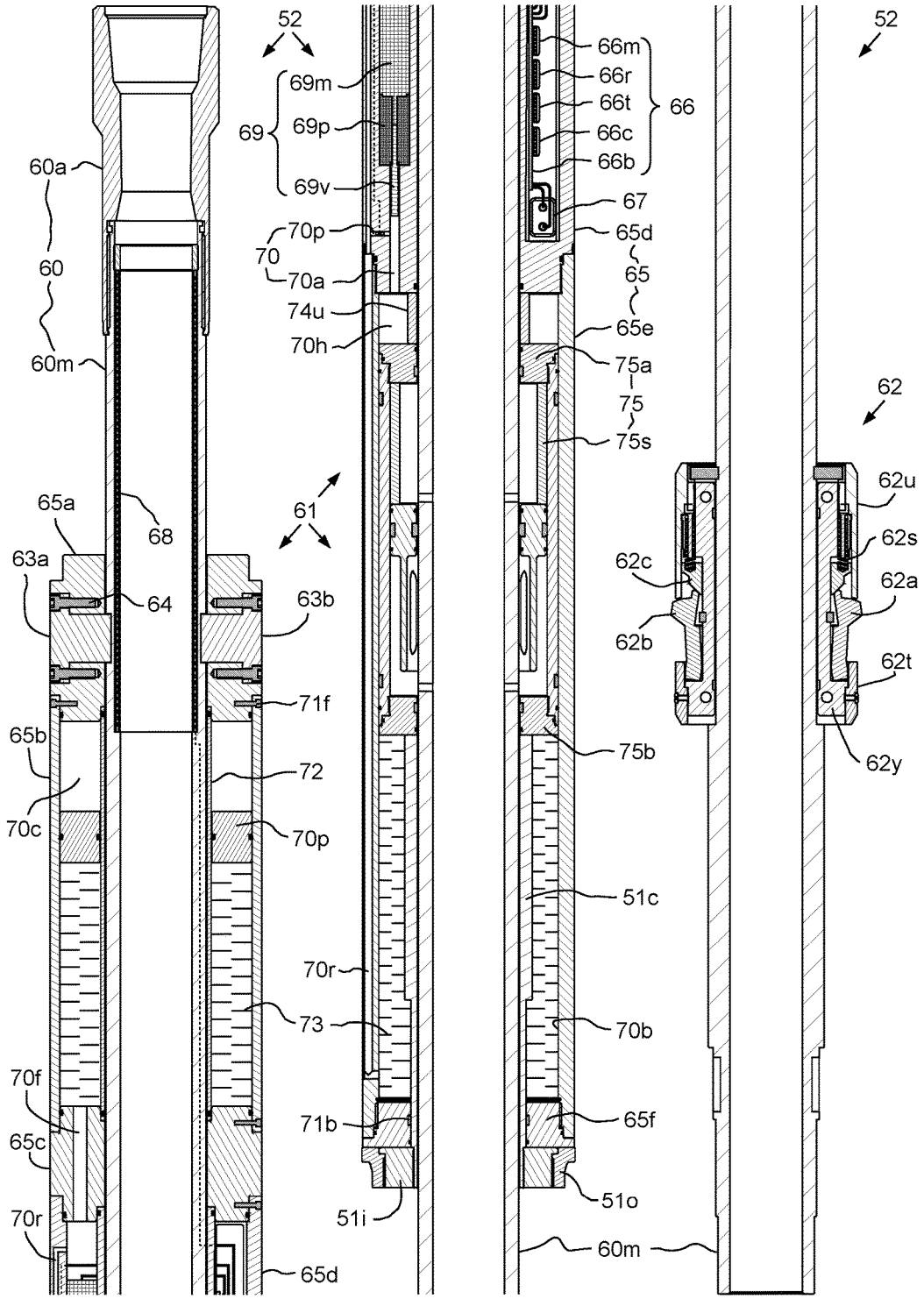
FIGS. 3A-3C illustrate a setting tool of the LDA.

FIGS. 3A-3C illustrate the setting tool 52. The setting tool 52 may include the junk bonnet 51, a mandrel 60, a controller 61, a latch 62, and a barrel 75. The mandrel 60 may have a bore formed therethrough and include two or more tubular sections 60*a,m* connected together, such as by threaded couplings and/or fasteners. An adapter mandrel section 60*a* may have a threaded coupling, such as a box, formed at an upper end thereof for connection to the diverter valve 50. The controller 61 may include a housing 65, an electronics package 66, a power source, such as a battery 67, an antenna 68, an actuator 69, and hydraulics 70. The housing 65 may have a bore formed therethrough and include two or more tubular sections 65*a-f*.

Alternatively, the power source may be a capacitor or inductor instead of the battery 67.

Each of an adapter housing section 65*a* and an upper portion of the mandrel main section 60*b* may have one or more (two shown) corresponding keyways. The housing adapter section 65*a* may have a flange formed in a wall thereof adjacent to the respective keyway for receiving a respective complementary key 63*a,b*. Each flange may have one or more (two shown) threaded sockets formed therein. Each key 63*a,b* may have a flange portion and a shank portion. The key flange portion may engage the respective flange of the housing adapter section 65*a* and have sockets corresponding to the threaded sockets thereof. A threaded fastener 64 may be inserted through each flange portion and screwed into the respective threaded socket of the housing adapter section 65*a*, thereby fastening the keys 63*a,b* thereto. Each key shank portion may extend through the respective keyway of the housing adapter section 65*a* and into the respective keyway of the main mandrel section, thereby longitudinally and torsionally connecting the housing 65 and the mandrel 60. The main mandrel section 60*b* may have one or more (two shown) keyways formed adjacent to a lower end thereof for connection to an upper end of the running tool 53 using keys (FIG. 2B) similar to the keys 63*a,b*.

The adapter housing section 65*a* may also have inner and outer shoulders formed at a lower end thereof. An upper end of a second housing section 65*b* may be received by the outer shoulder and the second housing section may be connected to the adapter housing section 65*a*, such as by one or more (two shown) fasteners 71*f*. An interface formed between the adapter 65*a* and second 65*b* housing sections may be isolated by a seal. An upper end of a cylinder 72 may be received by the inner shoulder and an interface formed between the adapter housing section 65*a* and the cylinder may be isolated by a seal.

A third housing section 65*c* may have inner and outer shoulders formed at an upper end thereof. A lower end of the second housing section 65*b* may be received by the outer shoulder and the second housing section may be connected to the third housing section 65*c*, such as by a fastener 71*f*. An interface formed between the second and third housing sections 65*b,c* may be isolated by a seal. A lower end of the cylinder 72 may be received by the inner shoulder and an interface formed between the third housing section 65*c* and the cylinder may be isolated by a seal. The third housing section 65*c* may also have inner and outer shoulders formed at a lower end thereof. An upper end of an outer wall of a fourth housing section 65*d* may be received by the outer shoulder and the fourth housing section may be connected to the adapter housing section 65*a*, such as by a fastener 71*f*. An outer interface formed between the third and fourth housing sections 65*c,d* may be isolated by a seal. An upper end of an inner wall of a fourth housing section 65*d* may be received by the inner shoulder and an inner interface formed between the third and fourth housing sections 65*c,d* may be isolated by a seal.

The fourth housing section 65*d* may have a threaded coupling formed at a lower end thereof and an upper end of a fifth housing section 65*e* may have a complementary threaded coupling engaged therewith, thereby connecting the fourth and fifth housing sections 65*d,e*. The fourth housing section 65*d* may also have a seal shoulder formed adjacent to the coupling thereof and the fifth housing section 65*e* may have a stinger formed adjacent to the coupling thereof. The stinger and seal shoulder may engage upon screwing the fourth and fifth housing sections 65*d,e* together and the interface therebetween may be isolated by inner and outer seals. An interface between the fourth housing section 65*d* and the main mandrel section 60*m* may be isolated by a seal.

The fifth housing section 65*e* may have a threaded coupling formed at a lower end thereof and an outer surface of a sixth housing section 65*f* may have a complementary threaded coupling engaged therewith, thereby connecting the fifth and sixth housing sections 65*e,f*. An interface between the fifth and sixth housing sections 65*e,f* and an interface between the sixth housing section 65*f* and a catch sleeve 51*c* of the junk bonnet 51 may each be isolated by a seal. The sixth housing section 65*f* may also carry a slide bearing 71*b* for facilitating longitudinal movement relative to the catch sleeve 51*c*.

The hydraulics 70 may include one or more chambers, such as a reservoir chamber 70*c*, an actuation chamber 70*h*, and a balance chamber 70*b*, a reservoir piston 70*p*, hydraulic fluid 73, and one or more hydraulic passages, such as a reservoir passage 70*f*, a return passage 70*r*, and an actuation passage 70*a*. The hydraulic fluid 73 may be water, refined oil, or synthetic oil. The reservoir chamber 70*c* may be formed radially between the second housing section 65*b* and the cylinder 72 and longitudinally between a lower face of the adapter housing section 65*a* and an upper face of the third housing section 65*c*. The reservoir piston 76*p* may be disposed in the reservoir chamber may divide the chamber into an upper portion and a lower portion. The reservoir chamber upper portion may have a gas pocket for accommodating actuation of the setting tool 52. The hydraulic fluid 73 may be disposed in the reservoir chamber lower portion. The reservoir piston 70*p* may carry inner and outer seals for isolating the hydraulic fluid 73 in the lower portion from the reservoir chamber upper portion.

The reservoir passage 70*f* may be formed through a wall of the third housing section 65*c* and may provide fluid communication between the reservoir chamber lower portion and an inlet of the actuator 69. The return passage 70*r* may be formed through walls of the fourth and fifth housing sections 65*d,e* and may provide fluid communication between the actuator inlet and the balance chamber 70*b*. The bypass passage 70*p* may be formed in a wall of the fourth housing section 65*d* and may have a shutoff valve for providing selective fluid communication between the return passage 70*r* and the actuation passage 70*a*. The actuation passage 70*a* may be formed in a wall of the fourth housing section 65*d* and may provide fluid communication between an outlet of the actuator 69 and the actuation chamber 70*h*.

The actuation chamber 70*h* may be variable volume and may be formed radially between the main mandrel section 60*m* and the fifth housing section 65*e* and longitudinally between a lower face of the fourth housing section 65*d* and an upper face of the barrel 75. The balance chamber 70*b* may be variable volume and may be formed radially between the main mandrel section 60*m* and the fifth housing section 65*e* and longitudinally between a lower face of the barrel 75 and an upper face of the sixth housing section 65*f*.

The actuator 69 may include the electric motor 69*m*, a pump 69*p*, a control valve, such as spool valve 66*v*, and a pressure sensor (not shown). The electric motor 69*m* may include a stator in electrical communication with a motor controller 66*m* and a head in electromagnetic communication with the stator for being driven thereby. The motor head may be longitudinally or torsionally driven. The pump 69*p* may have a stator connected to the motor stator and a cylinder connected to the motor head (directly or via lead screw) for being reciprocated thereby. The pump 69*p* may have the inlet in fluid communication with the reservoir passage 70*f* and the outlet in fluid communication with the actuation passage 70*a*. The spool valve 66*v* may selectively provide fluid communication between the pump piston and the inlet or outlet depending on the stroke. The spool valve 66*v* may be mechanically, electrically, or hydraulically operated. The pressure sensor may be in fluid communication with the pump outlet and a microcontroller (MCU) of a control circuit 66*c* may be in electrical communication with the pressure sensor to determine when the liner hanger 15*h* has been set by detecting a corresponding pressure increase at the outlet of the pump 69*p*.

The fourth housing section 65*d* may have electrical conduits formed through a wall thereof for receiving lead wires connecting the actuator 69 to the electronics package 66 and connecting the shutoff valve of the bypass passage 70*p* to the electronics package. The fourth housing section 65*d* may also have a cavity formed in the wall thereof for receiving the actuator 69. The actuator 69 may be connected to the housing 65, such as by interference fit or fastening. Lead wires may also extend from the electronics package 66 to the antenna 68 through a gap formed between the housing 65 and the mandrel 60 (shown extending through a wall of the main mandrel section 60*m* for clarity).

The antenna 68 may be tubular and extend along an inner surface of the main mandrel section 60*m*. The antenna 68 may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna lead wires may be connected to ends of the antenna coil. The antenna 68 may be received in a recess formed in an inner surface of the main mandrel section 60*m* and the main mandrel section may have a thread formed in an inner surface thereof adjacent to the recess. A nut may be screwed into the mandrel thread against the antenna 68, thereby connecting the antenna to the mandrel 60.

The fourth housing section 65*d* may have one or more (only one shown) pockets formed in the wall thereof. Although shown in the same pocket, the electronics package 66 and battery 67 may be disposed in respective pockets of the fourth housing section 65*d*. The electronics package 66 may include the control circuit 66*c*, a transmitter 66*t*, a receiver 66*r*, and the motor controller 66*m* integrated on a printed circuit board 66*b*. The control circuit 66*c* may include the MCU, a memory unit (MEM), a clock, and an analog-digital converter. The transmitter 66*t* may include an amplifier (AMP), a modulator (MOD), and an oscillator (OSC). The receiver 66*r* may include an amplifier (AMP), a demodulator (MOD), and a filter (FIL). The motor controller 66*m* may include a power converter for converting a DC power signal supplied by the battery 67 into a suitable power signal for driving the electric motor 69*m*. The electronics package 66 may be housed in an encapsulation.

Figure 1D:
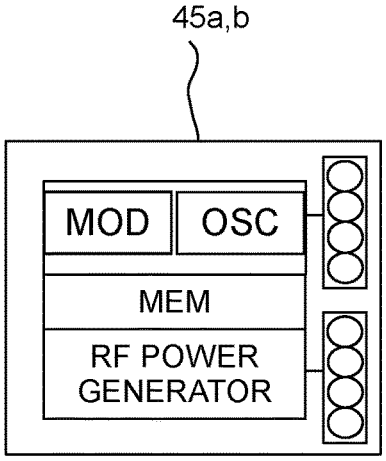
FIG. 1D illustrates a radio frequency identification (RFID) tag of the drilling system.

FIG. 1D illustrates the RFID tags 45*a,b*. Each RFID tag 45*a,b* may be a passive tag and include an electronics package and one or more antennas housed in an encapsulation. The electronics package may include a memory unit, a transmitter, and a radio frequency (RF) power generator for operating the transmitter. A first RFID tag 45*a* may be programmed with a command signal addressed to the setting tool 52, a second RFID tag 45*b* may be programmed with a command signal addressed to the running tool 53, and the dart 43 may have a third RFID tag (not shown) embedded therein programmed with a command signal addressed to the plug release system 58. Each RFID tag 45*a,b* may be operable to transmit a wireless command signal 49*c* (FIGS. 4A, 4C, and 5G), such as a digital electromagnetic command signal, to the respective antenna 68 in response to receiving an activation signal 49*a* therefrom. The MCU of the respective control circuit 69*c* may receive the command signal 49*c* and operate the respective actuator 66 in response to receiving the command signal.

Figure 1E:
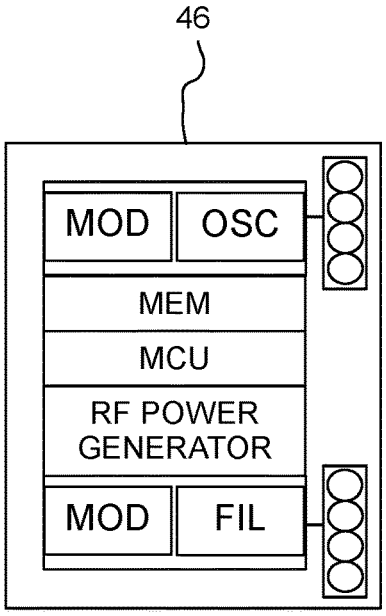
FIG. 1E illustrates an alternative RFID tag.

FIG. 1E illustrates an alternative RFID tag 46. Alternatively, one or more of the RFID tags 45*a,b* may instead be a wireless identification and sensing platform (WISP) RFID tag 46. The WISP tag 46 may further a microcontroller (MCU) and a receiver for receiving, processing, and storing data from the setting tool 52, running tool 53, and/or plug release system 58. Alternatively, one or more of the RFID tags 45*a,b* may be an active tag having an onboard battery powering a transmitter instead of having the RF power generator or the WISP tag may have an onboard battery for assisting in data handling functions. The active tag may further include a safety, such as pressure switch, such that the tag does not begin to transmit until the tag is in the wellbore.

Figure 6:
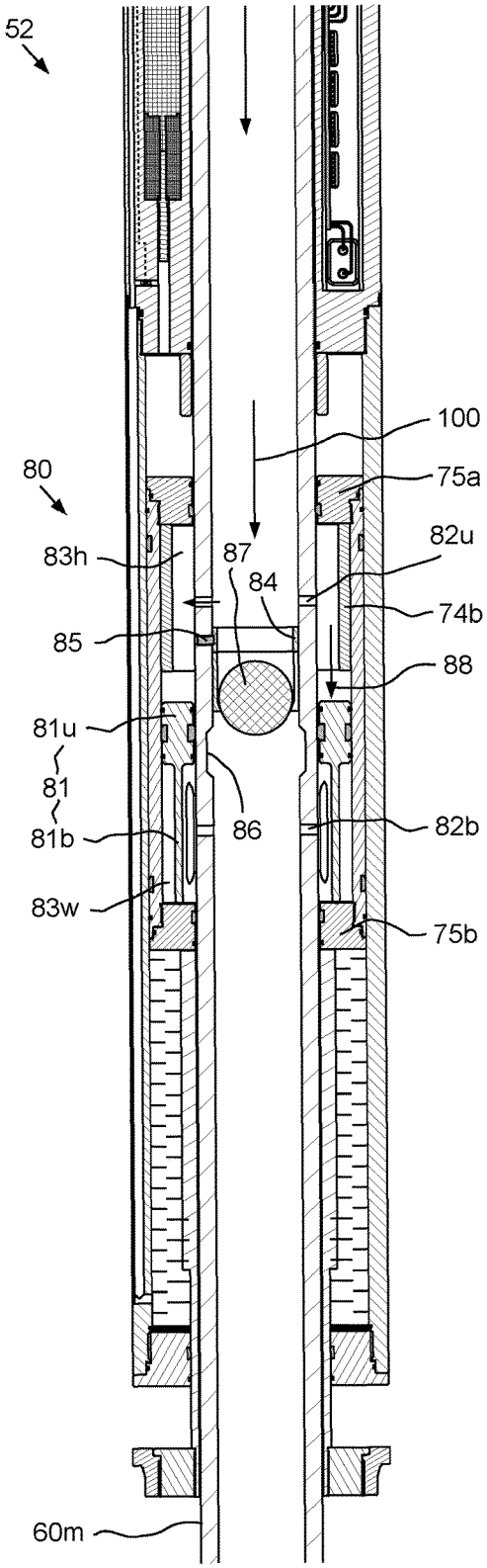
FIG. 6 illustrates operation of the setting tool using a manual override.

Returning to FIGS. 3A-3C, the barrel 75 may be disposed in a bore of the fifth housing section 65*e*. The barrel 75 may include an actuation piston 75*a*, a balance piston 75*b*, a sleeve 75*s*, and an override 80 (FIG. 6). The barrel 75 may be longitudinally movable relative to the housing 65 and the mandrel 60 between a retracted position (shown) and an extended position (FIG. 4B partially extended and FIG. 4K fully extended). The retracted position may be adjustable by an upper standoff 74*u* disposed between an upper face of the actuation piston 75*a* and a lower face of the fourth housing section 65*d*.

The actuation piston 75*a* may have a threaded coupling formed in an outer surface thereof and an upper end of the barrel sleeve 75*s* may have a complementary threaded coupling engaged therewith, thereby connecting the two barrel members. An interface between the actuation piston 75*a* and the barrel sleeve 75*s* and an interface between the actuation piston 75*a* and the main mandrel section 60*m* may each be isolated by a seal. The actuation piston 75*a* may also carry a slide bearing 71*b* for facilitating longitudinal movement relative to the mandrel 60. An interface between the fifth housing section 65*e* and the barrel sleeve 75*s* may be isolated by one or more (two shown) seals. The barrel sleeve 75*s* may also carry one or more (two shown) slide bearings 71*b* for facilitating longitudinal movement relative to the housing 65. The balance piston 75*b* may have a threaded coupling formed in an outer surface thereof and a lower end of the barrel sleeve 75*s* may have a complementary threaded coupling engaged therewith, thereby connecting the two barrel members. An interface between the balance piston 75*b* and the barrel sleeve 75*s* and an interface between the balance piston 75*b* and the main mandrel section 60*m* may each be isolated by a seal. The balance piston 75*b* may also carry a slide bearing 71*b* for facilitating longitudinal movement relative to the mandrel 60.

The junk bonnet 51 may include an outer ring 51*o*, an inner ring 51*i*, and the catch sleeve 51*c*. Subject to engagement with the balance piston 75*b* and the sixth housing section 65*f*, the junk bonnet 51 may be longitudinally movable relative to the mandrel 60, the housing 65, and the barrel 75. The inner ring 51*i* may have a threaded coupling formed in an inner surface thereof and a lower end of the catch sleeve 51*c* may have a complementary threaded coupling engaged therewith, thereby connecting the two junk bonnet members. The inner ring 51*i* may have a threaded coupling formed in an outer surface thereof and the outer ring 51*o* may have a complementary threaded coupling formed in an inner surface thereof and engaged therewith, thereby connecting the two junk bonnet members.

The catch sleeve 51*c* may have an upper enlarged portion, a lower reduced portion, and a shoulder formed between the two portions. The catch sleeve lower portion may slide along an interface formed between the sixth housing section 65*f* and the main mandrel section 60*m* and the shoulder may be sized to engage an upper face of the sixth housing section. The catch sleeve enlarged upper portion may engage a lower face of the balance piston 75*b* for being extended in response to downward movement of the barrel 75. The outer ring 51*o* may have a shoulder formed in an outer surface thereof for receiving the upper end of the setting sleeve 15*v*.

The latch 62 may include a body 62*y*, a plurality of fasteners, such as dogs 62*a,b*, a cam 62*c*, and a retainer 62*u,t*. The latch 62 may be disposed against a shoulder formed in an outer surface of the main mandrel section 60*m* and fastened to the main mandrel section by a snap ring. The latch 62 may carry one or more (two shown) radial bearings for facilitating rotation of the latch 62 relative to the mandrel 60. The body 62*y* may have a threaded coupling formed in an outer surface thereof and an upper member 62*u* of the retainer 62*u,t* may have a complementary threaded coupling formed in an inner surface thereof and engaged therewith, thereby connecting the retainer to the body. A lower member 62*t* of the retainer 62*u,t* may be fastened to the body 62*y*.

Figures 2A, 2B, 2C, 2D:
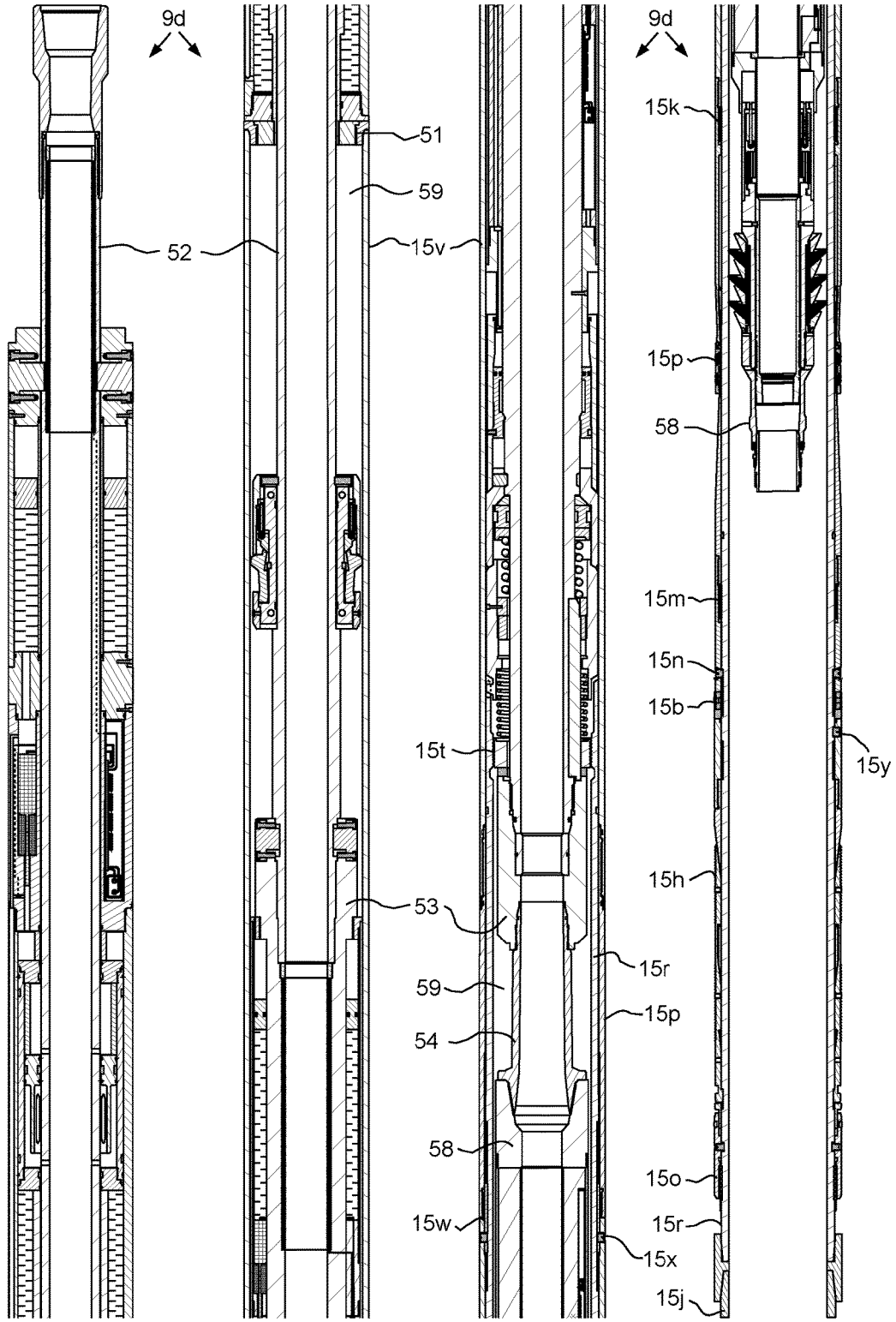
FIGS. 2A-2D illustrate a liner deployment assembly (LDA) of the drilling system.
Figures 4A, 4B, 4C, 4D, 4E, 4F:
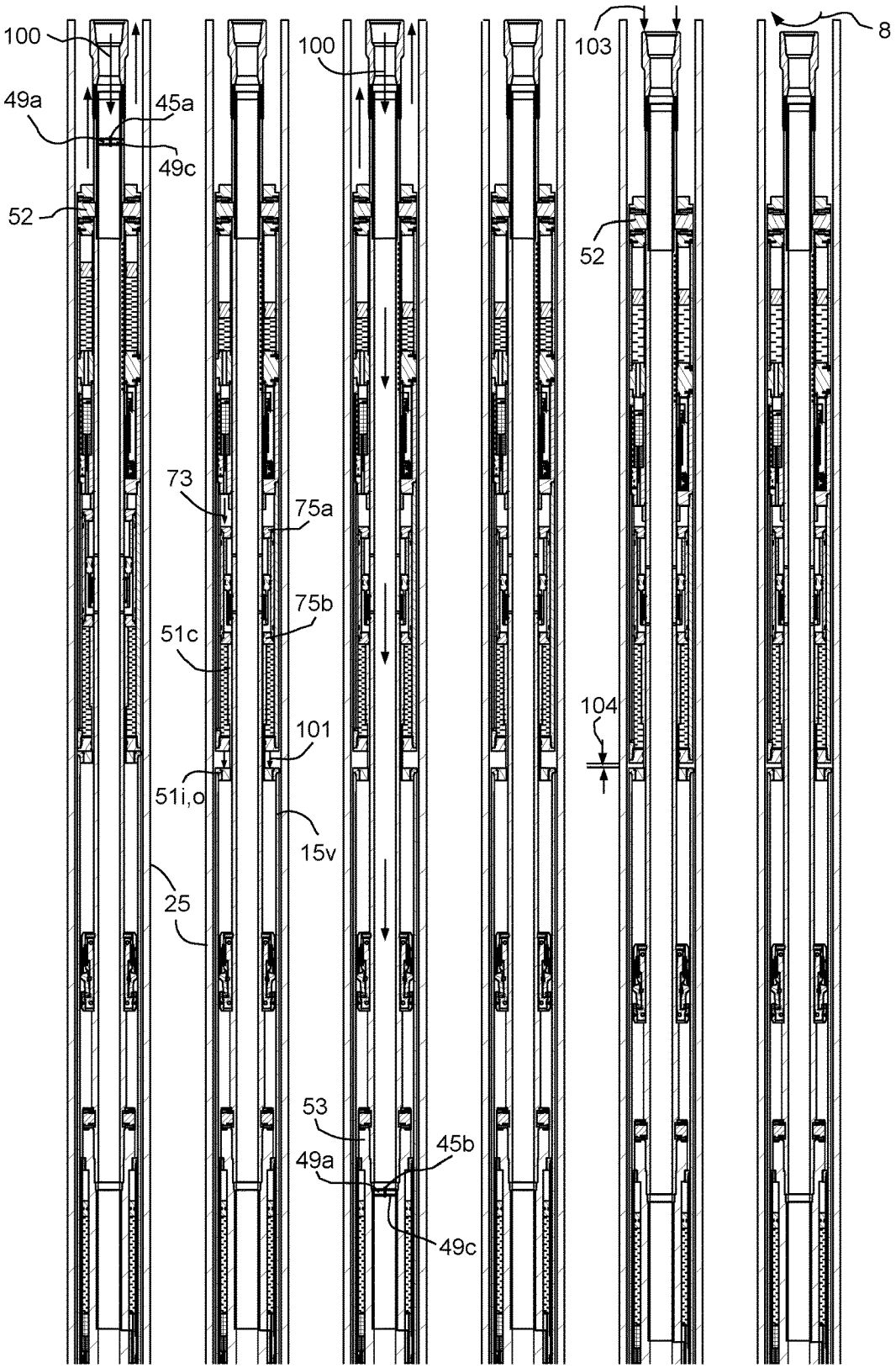
FIGS. 4A-4M illustrate operation of an upper portion of the LDA.
Figures 4G, 4H, 4I, 4J, 4K, 4L:
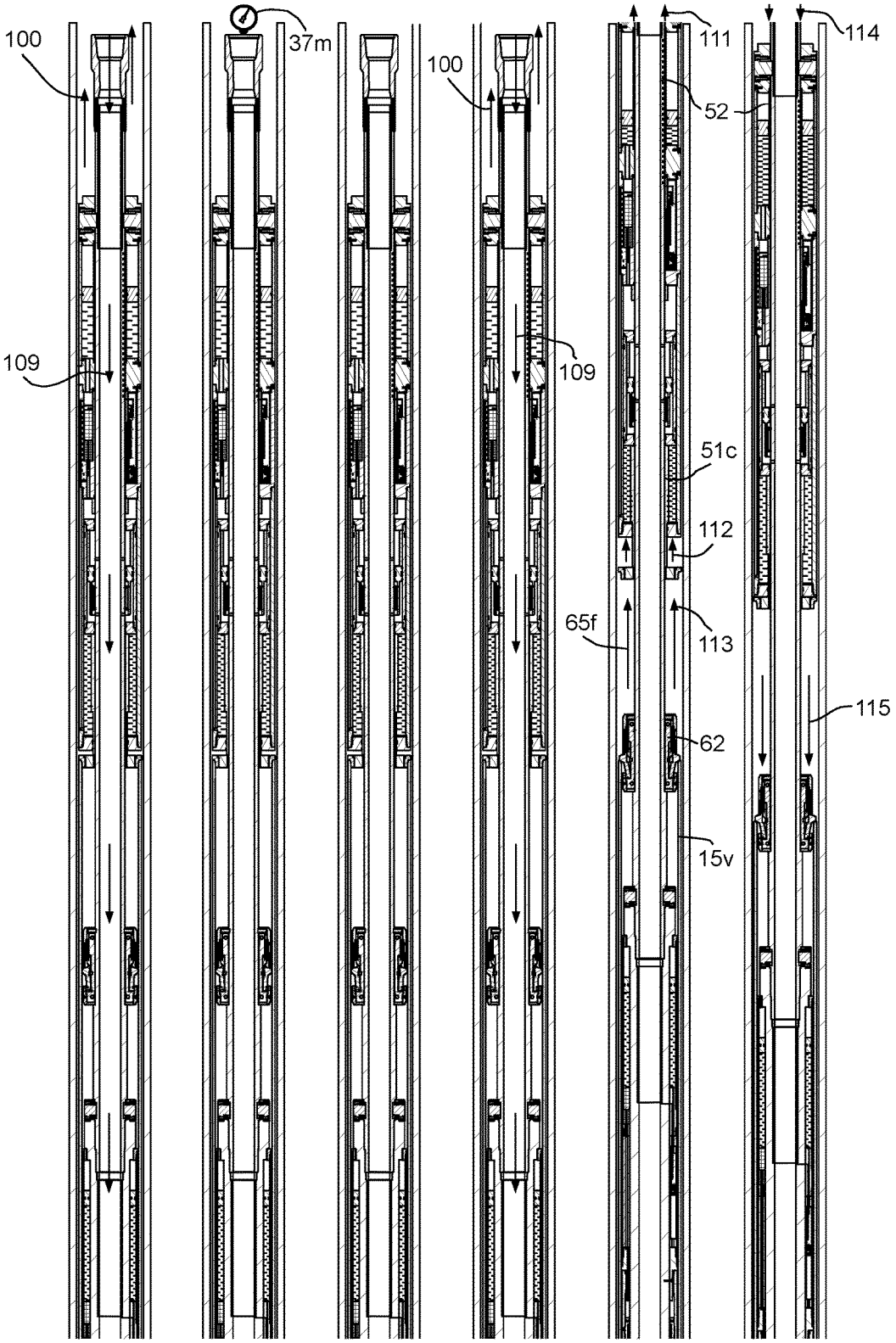

A pocket may be formed between the latch body 62*y* and the retainer 62*u,t*. The dogs 62*a,b* may be disposed in the pocket and spaced around the pocket. Each dog 62*a,b* may be movable relative to the body 62*y* and retainer 62*u,t* between a retracted position (shown) and an extended position (FIG. 4K). The cam 62*c* may be disposed in the pocket and longitudinally movable relative to the body 62*y* and the retainer 62*u,t* between an upper position (shown) and a lower position (FIG. 4K). The cam 62*c* may be urged toward the lower position by a biasing member, such as one or more (two shown) compression springs 62*s*. Each dog 62*a,b* may have an outer lug for engagement with the setting sleeve 15*v* and an inner cam surface engaged with the cam 62*c*. The lower retainer 62*b*, each dog 62*a,b*, and the body 62*y* may be torsionally connected, such as by a fastener (not shown). The dogs 62*a,b* may be held in the retracted position by insertion of the latch into the setting sleeve 15*v* (FIG. 2B)

Returning to FIGS. 2B-2D, the running tool 53 may include a body, a controller, a lock, a clutch, and a latch. The body may have a bore formed therethrough and include two or more tubular sections. An inner body section may be connected to a lower body section, such as by threaded couplings. A spacer may be disposed between a lower end of the inner body section and a shoulder formed in an inner surface of the lower body section. A fastener, such as a threaded nut, may be connected to a threaded coupling formed in an outer surface of the inner body section and may receive an upper end of the outer housing section. The body may also have a threaded coupling formed at a lower longitudinal end thereof for connection to the stinger 54.

The running tool controller may include a housing, an electronics package similar to the electronics package 66, a power source, such as a battery, an antenna similar to the antenna 68, an actuator similar to the actuator 69, and hydraulics. The housing may have a bore formed therethrough and include two or more tubular sections. A lower housing section may be connected to the inner body section, such as by a threaded fastener. The lower housing section may receive a lower end of the outer body section, thereby connecting the outer body section to the inner body section. The nut may also receive an upper end of an upper housing section and a second housing section may receive a lower end of the upper housing section. The second housing section may also receive an upper end of a third housing section. The lower housing section may receive a lower end of the third housing section, thereby connecting the housing to the inner body section.

The running tool hydraulics may include a reservoir chamber, a balance piston, hydraulic fluid similar to hydraulic fluid 73, and a hydraulic passage. The balance piston may be disposed in the reservoir chamber formed between the upper housing section and the inner body section and may divide the chamber into an upper portion and a lower portion. A port may be formed through a wall of the nut and may provide fluid communication between the reservoir chamber upper portion and the buffer chamber 59. The hydraulic fluid may be disposed in the reservoir chamber lower portion. The balance piston may carry inner and outer seals for isolating the hydraulic fluid from the reservoir chamber upper portion.

The running tool second housing section may have an electrical conduit formed through a wall thereof for receiving lead wires connecting the antenna to the electronics package and connecting the actuator to the electronics package. The second housing section may also have a cavity formed in an upper end thereof for receiving the actuator. The actuator may be connected to the housing, such as by interference fit or fastening. The hydraulic passage may provide fluid communication between the actuator and the lock. An upper portion of the hydraulic passage may be formed through a wall of the third housing section and a lower portion of the hydraulic passage may be formed through a wall of the lower housing section. The running tool third housing section may have one or more (only one shown) pockets formed in an outer surface thereof. Although shown in the same pocket, the electronics package and battery may be disposed in respective pockets of the third housing section. The actuator pump may have an inlet in fluid communication with the lower reservoir chamber portion and an outlet in fluid communication with the hydraulic passage.

The running tool latch may longitudinally and torsionally connect the PBR 15*r* to an upper portion of the LDA 9*d*. The latch may include a thrust cap, a longitudinal fastener, such as a floating nut, and a biasing member, such as a lower compression spring. The thrust cap may have an upper shoulder formed in an outer surface thereof and adjacent to an upper end thereof, an enlarged mid portion, a lower shoulder formed in an outer surface thereof, a torsional fastener, such as a key, formed in an outer surface thereof, a lead screw formed in an inner surface thereof, and a spring shoulder formed in an inner surface thereof. The key may mate with a torsional profile, such as a castellation, formed in an upper end of the PBR 15*r* and the floating nut may be screwed into a thread 15*t* of the PBR 15*r*. The lock may be disposed on the inner body section to prevent premature release of the latch from the PBR 15*r*. The clutch may selectively torsionally connect the thrust cap to the running tool body.

The running tool lock may include a piston, a plug, a fastener, such as a dog, and a sleeve. The plug may be connected to an outer surface of the inner body section, such as by threaded couplings. The plug may carry an inner seal and an outer seal. The inner seal may isolate an interface formed between the plug and the body and the outer seal may isolate an interface formed between the plug and the piston. The piston may be longitudinally movable relative to the body between an upper position (FIG. 4C) and a lower position (shown). The piston may initially be fastened to the plug, such as by a shearable fastener. In the lower position, the piston may have an upper portion disposed along an outer surface of the lower housing section, a mid portion disposed along an outer surface of the plug, and a lower portion received by the lock sleeve, thereby locking the dog in a retracted position. The piston may carry an inner seal in the upper portion for isolating an interface formed between the body and the piston. An actuation chamber may be formed between the piston, plug, and the inner body section. A lower end of the hydraulic passage may be in fluid communication with the actuation chamber.

Figures 5A, 5B, 5C, 5D, 5E, 5F:
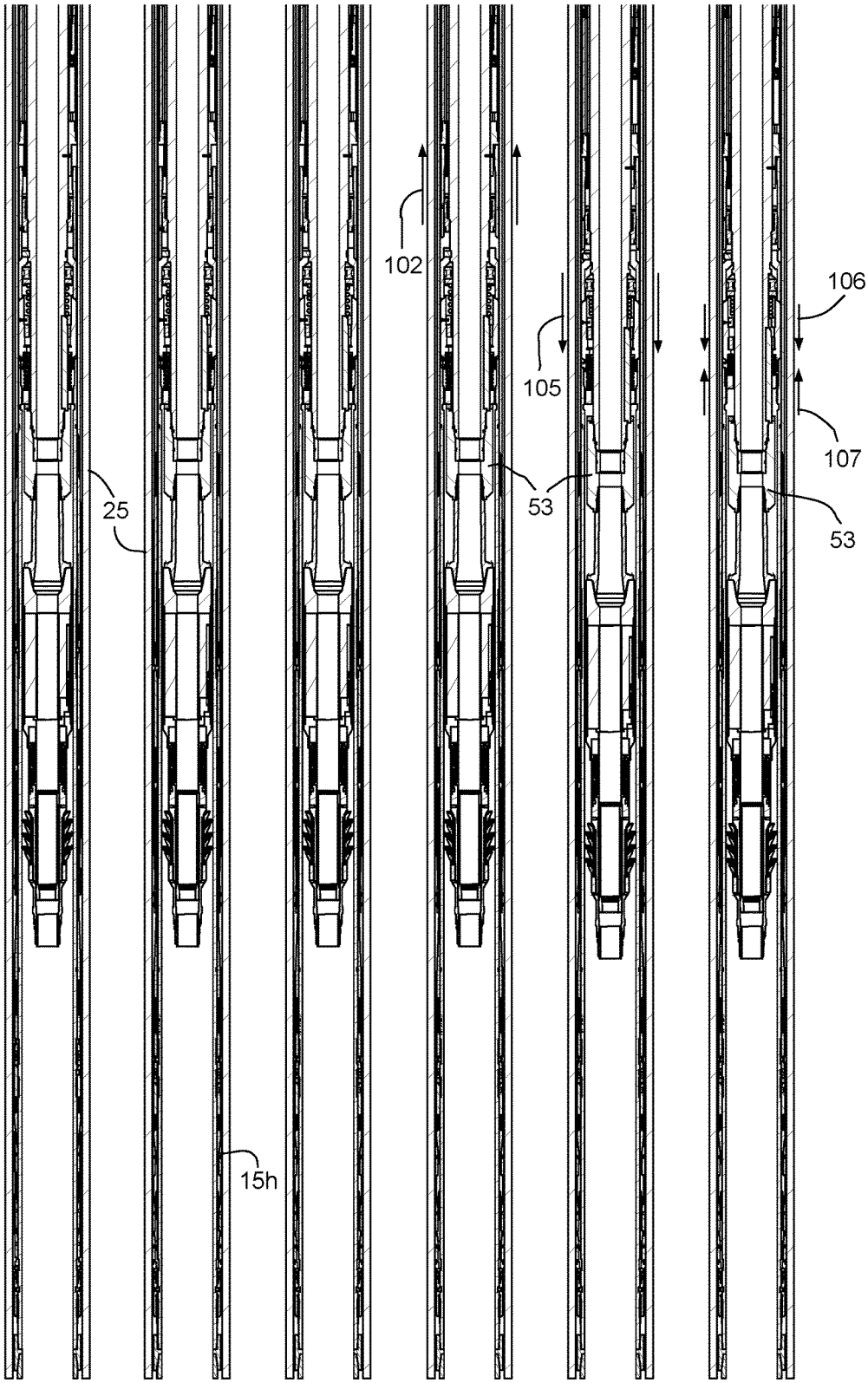
FIGS. 5A-5M illustrate operation of a lower portion of the LDA.

The running tool lock sleeve may have an upper portion disposed along an outer surface of the inner body section and an enlarged lower portion. The lock sleeve may have an opening formed through a wall thereof to receive the dog therein. The dog may be radially movable between the retracted position (shown) and an extended position (FIG. 5E). In the retracted position, the dog may extend into a groove formed in an outer surface of the inner body section, thereby fastening the lock sleeve to the body. The groove may have a tapered upper end for pushing the dog to the extended position in response to relative longitudinal movement therebetween.

The running tool clutch may include a biasing member, such as upper compression spring, a thrust bearing, a gear, a lead nut, and a torsional coupling, such as key. The thrust bearing may be disposed in the lock sleeve lower portion and against a shoulder formed in an outer surface of the inner body section. A spring washer may be disposed adjacent to a bottom of the thrust bearing and may receive an upper end of the clutch spring, thereby biasing the thrust bearing against the running tool body shoulder. The inner body section may have a torsional profile, such a keyway formed in an outer surface thereof adjacent to a lower end thereof. The key may be disposed the keyway. The key may be kept in the keyway by entrapment between a shoulder formed in an outer surface of the lower body section and a shoulder formed in an upper end of the lower body section.

The running tool gear may be connected to the thrust cap, such as by a threaded fastener, and have teeth formed in an inner surface thereof. Subject to the lock, the gear and thrust cap may be movable between an upper position (FIG. 5E) and a lower position (shown). In the lower position, the gear teeth may mesh with the key, thereby torsionally connecting the thrust cap to the body. The lead nut may be engaged with the lead screw and have a keyway formed in an inner surface thereof and engaged with the key, thereby longitudinally connecting the lead nut and the thrust cap while providing torsional freedom therebetween and torsionally connecting the lead nut and the body while providing longitudinal freedom therebetween. A lower end of the clutch spring may bear against an upper end of the gear. The thrust cap and gear may initially be trapped between a lower end of the lock sleeve and a shoulder formed in an outer surface of the key.

The running tool spring shoulder of the thrust cap may receive an upper end of the latch spring. A lower end of the latch spring may be received by a shoulder formed in an upper end of the float nut. A thrust ring may be disposed between the float nut and an upper end of the lower body section. The float nut may be urged against the thrust ring by the latch spring. The float nut may have a thread formed in an outer surface thereof. The thread may be opposite-handed, such as left handed, relative to the rest of the threads of the workstring 9. The float nut may be torsionally connected to the body by having a keyway formed along an inner surface thereof and receiving the key, thereby providing upward freedom of the float nut relative to the body while maintaining torsional connection thereto. Threads of the lead nut and lead screw may have a finer pitch, opposite hand, and greater number than threads of the float nut and packer dogs to facilitate lesser (and opposite) longitudinal displacement per rotation of the lead nut relative to the float nut.

The plug release system 58 may include a launcher and the cementing plug, such as a wiper plug. Each of the launcher and wiper plug may be a tubular member having a bore formed therethrough. The launcher may include a housing, an electronics package similar to the package 66, a power source, such as a battery, an antenna similar to the antenna 68, a mandrel, and a latch. The housing may include two or more tubular sections connected to each other, such as by threaded couplings. The housing may have a coupling, such as a threaded coupling, formed at an upper end thereof for connection to the stinger 54. The mid housing section may have an enlarged inner diameter to form an electronics chamber for receiving the antenna and the mandrel.

The plug release system lower housing section may have a groove formed in an upper end and inner surface thereof and the antenna flange may be disposed in the groove and trapped therein by a lower end of the mandrel, thereby connecting the antenna to the housing. The mandrel may be a tubular member having one or more (only one shown) pockets formed in an outer surface thereof. The mandrel may be connected to the housing by entrapment between a lower end of the upper housing section and an upper end of the lower housing section. The mandrel, housing, and/or latch may have electrical conduits formed in a wall thereof for receiving wires connecting the antenna to the electronics package, connecting the battery to the electronics package, and connecting the latch to the electronics package. The actuator controller may include a power converter for converting a DC power signal supplied by the battery into a suitable power signal for driving an actuator of the latch.

The plug release system latch may include a retainer sleeve, a receiver chamber, the actuator, a lock sleeve, and a fastener, such as a collet. An upper end of the retainer sleeve may be connected to a lower end of the lower housing section, such as by threaded couplings. The receiver chamber may be formed in an inner surface of the lower housing section and occupy a mid and lower portion thereof. The actuator may be linear and include a solenoid, a guide, and a hub. Each of the solenoid and guide may include a shaft and a cylinder. The hub may have a threaded socket formed therethrough for each actuator shaft. An upper end of each actuator shaft may be threaded and received in the respective socket, thereby connecting the solenoid and guide to the hub.

Figures 5G, 5H, 5I, 5J, 5K, 5L:
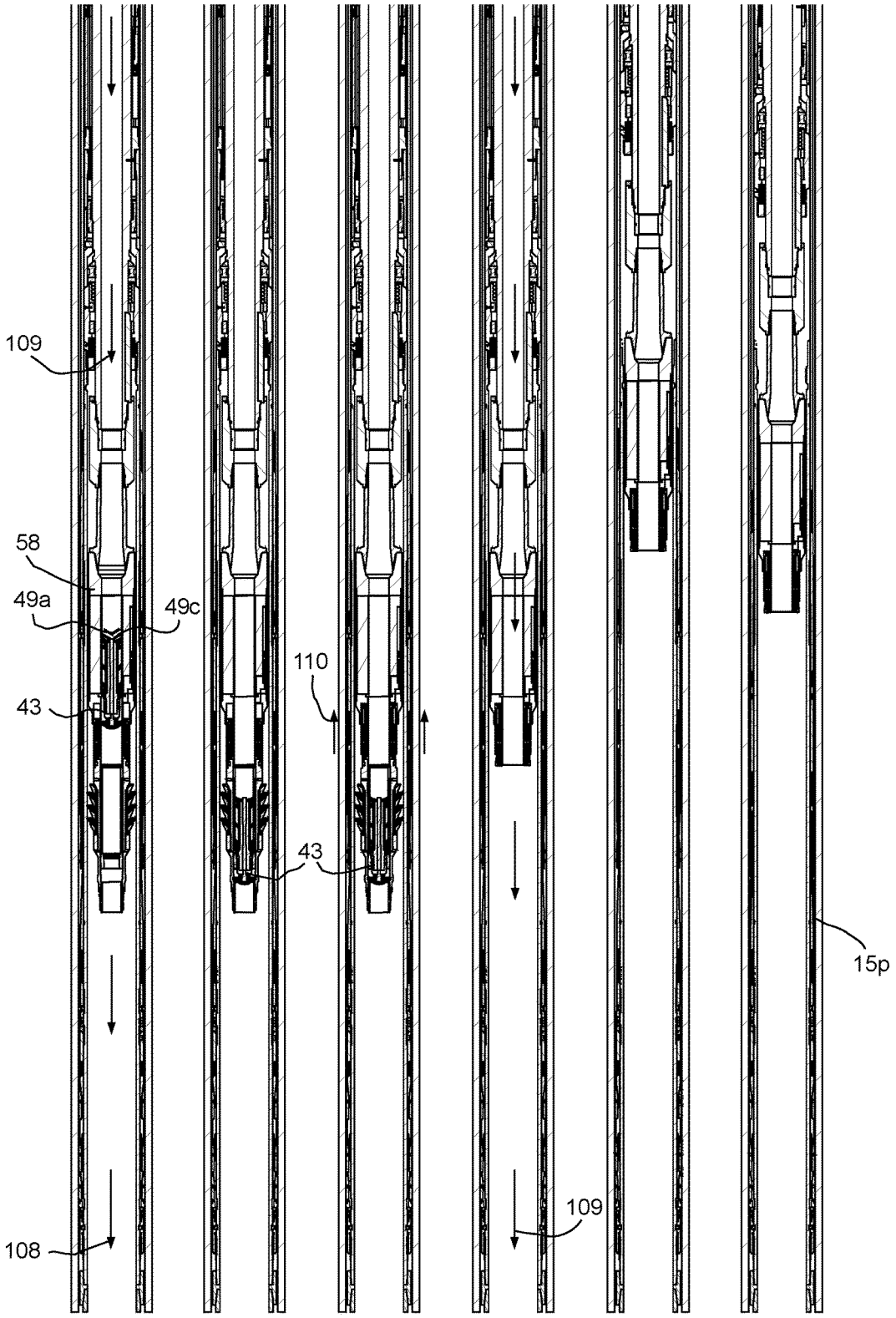

The plug release system lock sleeve may have a threaded coupling formed at an upper end thereof for receiving a threaded coupling formed in an outer surface of the hub, thereby connecting the lock sleeve and the hub. The lock sleeve may be longitudinally movable by the actuator and relative to the housing between a lower position (shown) and an upper position (FIG. 5I). The lock sleeve may be stopped in the lower position by engagement of a lower end thereof with a stop shoulder of the wiper plug. The collet may have an upper base portion and fingers extending from the base portion to a lower end thereof. The collet base may have a threaded socket formed in an upper end thereof for each actuator cylinder. A lower end of each actuator cylinder may be threaded and received in the respective socket, thereby connecting the solenoid and guide to the collet. The collet base may have a threaded inner surface for receiving a threaded outer surface of the retainer sleeve, thereby connecting the collet and the housing. The retainer sleeve may have a stop shoulder formed in an outer surface thereof for receiving an upper end of the wiper plug.

The plug release system collet may be radially movable between an engaged position (shown) and a disengaged position (FIG. 5J) by interaction with the lock sleeve. Each collet finger may have a lug formed at a lower end thereof. In the engaged position, the collet lugs may mate with a complementary groove of the wiper plug, thereby releasably connecting the wiper plug to the housing. The collet fingers may be cantilevered from the collet base and have a stiffness urging the lugs toward the disengaged position. Downward movement of the lock sleeve may press the collet lugs into the groove against the stiffness of the collet fingers. Upward movement of the lock sleeve may allow the stiffness of the collet fingers to pull the lugs from the groove, thereby releasing the wiper plug from the launcher.

The plug release system wiper plug may include a body, a mandrel, a stinger, a wiper seal, an anchor. The body may have the groove formed in an inner surface thereof adjacent to an upper end thereof, the stop shoulder formed in the inner surface thereof adjacent to the groove, one or more threaded sockets formed through a wall thereof, and a threaded coupling formed at a lower end thereof. Each of the body, mandrel, stinger, anchor, and seat may be made from a drillable material, such as cast iron, nonferrous metal or alloy, fiber reinforced composite, or engineering polymer. The mandrel may be disposed in a bore of the body, have a groove formed in an outer surface thereof, a landing profile formed in the inner surface thereof adjacent to a lower end thereof, and an upper seal groove and a lower seal groove, each formed in an outer surface thereof and each carrying a seal. The landing profile may have a landing shoulder, a latch profile, and a seal bore for receiving the dart 43 (FIG. 5H). The dart 43 may have a complementary landing shoulder, a fastener for engaging the latch profile, thereby connecting the dart and the wiper plug, and a seal for engaging the seal bore. A threaded fastener may be received in each threaded socket and extend into the groove, thereby connecting the mandrel and the body. The threaded fasteners may be shearable fasteners for serving as an override to release the wiper plug in the event of malfunction of the electronics package and/or the latch.

The plug release system stinger may have an upper threaded coupling formed in an inner surface thereof engaged with the body threaded coupling, thereby connecting the stinger and the body. The body may have a reduced outer diameter mid and lower portion to form recess for receiving the wiper seal. The wiper seal may be connected to the body by entrapment between a shoulder formed in an outer surface of the body and an upper end of the stinger. The wiper seal may include a fin stack, a backup stack, and a lower end adapter. Each stack may include one or more (three shown) units, each unit having a backup ring and a seal ring molded onto the respective backup ring. Each seal ring may be directional and made from an elastomer or elastomeric copolymer. An outer diameter of each seal ring may correspond to an inner diameter of the liner joints 15*j*, such as being slightly greater than. Each seal ring may oriented to sealingly engage the liner joints 15*j* in response to pressure above the seal ring being greater than pressure below the seal ring. Each backup ring and the adapter may be made from one of the drillable materials. The stinger upper end may have a groove for mating with a lower lip of the end adapter.

The plug release system anchor may include a mandrel, a longitudinal coupling, a torsional coupling, and an external seal. The stinger may have a lower threaded coupling formed in the inner surface thereof and an outer groove formed in a lower end thereof. The anchor mandrel may have a threaded coupling formed in an outer surface thereof engaged with the stinger threaded coupling, thereby connecting the stinger and the anchor. The anchor mandrel may have a groove formed in an inner surface thereof for carrying a seal, thereby isolating an interface formed between the anchor mandrel and the stinger. The external seal may be disposed in the stinger outer groove. A retainer may have an outer portion extending into the stinger outer groove and an inner portion trapped between the stinger lower end and an upper end of the torsional coupling, thereby trapping the external seal in the stinger outer groove. The torsional coupling may be a nut having a threaded inner surface engaged with the anchor mandrel threaded coupling and having one or more helical vanes formed on an outer surface thereof. The anchor mandrel may have a conical taper formed in an outer surface thereof and the longitudinal coupling may be disposed between the torsion nut and the conical taper. The longitudinal coupling may be a split ring having teeth formed along an outer surface thereof and a conical taper formed in an inner surface thereof complementary to the mandrel taper.

FIGS. 4A-4M illustrate operation of an upper portion of the LDA 9*d*. FIGS. 5A-5M illustrate operation of a lower portion of the LDA 9*d*. Referring specifically to FIGS. 4A and 5A, once the liner string 15 has been advanced into the wellbore 24 by the workstring 9 to a desired deployment depth and the cementing head 7 has been installed, conditioner 100 may be circulated by the cement pump 13 through the valve 41 to prepare for pumping of cement slurry. The first tag launcher 44*a* may then be operated and the conditioner 100 may propel the first tag 45*a* down the workstring 9 to the setting tool 52. The first tag 45*a* may transmit the command signal 49*c* to the antenna 68 as the tag passes thereby.

Referring specifically to FIGS. 4B and 5B, the setting tool MCU may receive the command signal 49*c* from the first tag 45*a* and may close the bypass valve in the bypass passage 70*p* and operate the motor controller 66*m* to energize the motor 69*m* and drive the pump 69*p*. The pump 69*p* may inject the hydraulic fluid 73 into the actuation chamber 70*h* via the passage 70*a*, thereby pressurizing the actuation chamber 70*h* and exerting pressure on the actuation piston 75*a*. The actuation piston 75*a* may in turn exert a setting force on the setting sleeve 15*v* via the barrel sleeve 75*s*, the balance piston 75*b*, the catch sleeve 51*c*, the inner ring 51*i*, and the outer ring 51*o*. The setting sleeve 15*v* may in turn exert the setting force on the liner hanger upper portion via the packer 15*p*. The liner hanger upper portion 15*h* may initially be restrained from setting the liner hanger by the shearable fastener 15*y*. Once a threshold pressure on the actuation piston 75*a* has been reached, the shearable fastener 15*y* may fracture, thereby releasing the liner hanger upper portion. The barrel 75, junk bonnet 51, setting sleeve 15*v*, and liner hanger upper portion may travel downward 101 until slips of the liner hanger 15*h* are set against the casing 25, thereby halting the movement. The setting tool MCU may then open the shutoff valve in the bypass passage 70*p* to equalize the actuation chamber 70*h* with the balance chamber 70*b* since the liner hanger 15*h* is restrained from unsetting by the lower ratchet connection 15*m*.

Referring specifically to FIGS. 4C and 5C, setting of the liner hanger 15*h* may be confirmed, such as by pulling on the drill pipe 9*p* using the drawworks 12. The second tag launcher 44*b* may then be operated to launch the second RFID tag 45*b* into the conditioner 100 and pumping continued to transport the second tag to the running tool 53. The second tag 45 may transmit the command signal 49*c* to the running tool antenna as the tag passes thereby.

Referring specifically to FIGS. 4D and 5D, the running tool MCU may receive the command signal from the second tag 45*b* and may operate the motor controller to energize the motor and drive the pump. The running tool pump may inject the hydraulic fluid into the actuation chamber via the hydraulic passage, thereby pressurizing the chamber and exerting pressure on the piston. Once a threshold pressure on the running tool piston has been reached, the shearable fastener may fracture, thereby releasing the piston. The running tool piston may travel upward 102 until an upper end thereof engages a shoulder formed in an outer surface of the lower housing section, thereby halting the movement.

Referring specifically to FIGS. 4E and 5E, the drill pipe 9*p*, mandrel 60, and housing 65 may then be lowered 103 while the barrel 75 and junk bonnet 51 remain stationary due to the setting tool 52 operating as a slip joint and accommodating the relative movement 104. The running tool thrust cap and lock sleeve may also move downward 105 until the lower shoulder engages a landing shoulder formed by a top of the PBR 15*r*. Continued lowering 103, 105 may cause the PBR shoulder to exert a reactionary force on the running tool thrust cap and lock sleeve, thereby pushing the dog against the groove taper. The running tool dog may be pushed to the extended position, thereby releasing the thrust cap and lock sleeve. Lowering 103, 105 may continue, thereby disengaging the running tool gear from the key. The lowering 103, 105 may be halted by engagement of the running tool thrust cap upper end with a lower end of the spring washer.

Referring specifically to FIGS. 4F and 5F, the drill pipe 9*p* may then be rotated 8 from surface by the top drive 5 to cause the running tool lead nut to travel down 106 the thrust cap lead screw while the float nut travels upward 107 relative to the thread of the PBR 15*r*. The running tool float nut may disengage from the PBR thread 15*t* before the running tool lead nut bottoms out in the threaded passage. The rotation 8 may be halted by the running tool lead nut bottoming out against a lower end of the lead screw, thereby restoring torsional connection between the running tool thrust cap and the running tool body.

Referring specifically to FIGS. 4G and 5G, an upper portion of the workstring 9 may then be raised and then lowered to confirm release of the running tool 53. The workstring upper portion and liner string 15 may then be rotated 8 from surface by the top drive 5 and rotation may continue during the cementing operation. Cement slurry 108 may be pumped from the mixer 42 into the cementing swivel 7*c* via the valve 41 by the cement pump 13. The cement slurry 108 may flow into the launcher 7*d* and be diverted past the dart 43 via the diverter and bypass passages. Once the desired quantity of cement slurry 108 has been pumped, the dart 43 may be released from the launcher 7*d* by operating the plug launcher actuator. Chaser fluid 109 may be pumped into the cementing swivel 7*c* via the valve 41 by the cement pump 13. The chaser fluid 109 may flow into the launcher 7*d* and be forced behind the dart 43 by closing of the bypass passages, thereby propelling the dart into the workstring bore. Pumping of the chaser fluid 109 by the cement pump 13 may continue until residual cement in the cement discharge conduit has been purged. Pumping of the chaser fluid 109 may then be transferred to the mud pump 34 by closing the valve 41 and opening the valve 6. The dart 43 and cement slurry 108 may be driven through the workstring bore by the chaser fluid 109 until the dart reaches the plug release system 58. The third tag embedded in the dart 43 may transmit the command signal 49*c* to the plug release system antenna as the dart passes thereby.

Referring specifically to FIGS. 4H and 5H, the plug release system MCU may receive the command signal 49*c* from the third tag and may wait for a preset period of time to allow the dart 43 to seat into the landing profile thereof and for the resulting increase in pressure to propagate to the pressure gauge 37*m* for confirmation of the dart landing. This preset period of time may be determined using the speed of sound through the chaser fluid 109 and the depth of the landing profile from the waterline 2*s* plus a margin for uncertainty.

Referring specifically to FIGS. 4I and 5I, after the delay period has lapsed, the plug release system MCU may operate the actuator controller 62*m* to energize the plug release system solenoid, thereby driving 110 the lock sleeve to the upper position and allowing the collet to release the combined dart 43 and wiper plug.

Referring specifically to FIGS. 4J and 5J, once released, the combined dart 43 and wiper plug may be driven through the liner bore by the chaser fluid 109, thereby driving the cement slurry 108 through the landing collar 15*c* and reamer shoe 15*s* into the annulus 48. Pumping of the chaser fluid may continue until the combined dart and wiper plug land on the collar 15*c*.

Referring specifically to FIGS. 4K and 5K, once the combined dart 43 and wiper plug have landed, pumping of the chaser fluid 109 may be halted and the workstring upper portion raised 111. During the raising 111, the sixth housing section 65*f* may engage the catch sleeve 51*c*, thereby pulling 112 the junk bonnet inner and outer rings 51*i,o* from engagement with the upper end of the setting sleeve 15*v*. Raising 111 may continue until the latch 62 exits 113 the bore of the setting sleeve 15*v*, thereby allowing the latch dogs to extend and engage the upper end of the setting sleeve.

Referring specifically to FIGS. 4L and 5L, weight 114 may then be exerted on the LDA 9*d* using the drawworks 12. The latch 62 may in turn exert a setting force 115 on the setting sleeve 15*v* via the latch dogs. The setting sleeve 15*v* may in turn exert the setting force 115 on the packer upper portion. The sleeve 115*w* of the releasable slip joint 15*w,x* may engage the lower shoulder of the PBR 15*r* and the shearable fasteners may fracture, thereby releasing the packer upper portion. The packer upper portion may include a metallic packing ring and the lower packer portion may include a cone. The latch 62 may drive the packing ring downward along the cone until the packing ring is expanded into engagement with the casing 25, thereby halting the movement. The packer 15*p* is restrained from unsetting by the upper ratchet connection 15*k*.

Figures 4M, 5M:
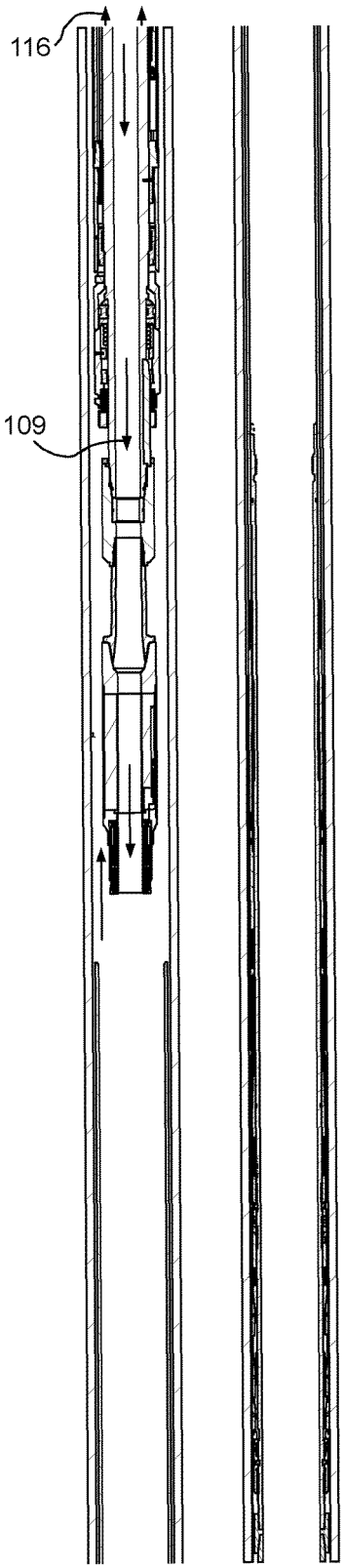

Referring specifically to FIGS. 4M and 5M, once the packer 15*p* has been set, rotation 8 of the workstring upper portion may be halted. The workstring upper portion may then be raised 116 using the drawworks 12 until the LDA 9*d* exits the setting sleeve 15*v*. Chaser fluid 109 may be circulated to wash away excess cement slurry. The workstring 9 may then be retrieved to the MODU 1*m*.

FIG. 6 illustrates operation of the setting tool 52 using the manual override 80. The override 80 may include a lower standoff 74*b*, an override piston 81, a set of one or more (two shown) upper override ports 82*u*, a set of one or more (two shown) lower override ports 82*b*, an override chamber 83*h,w*, and a seat 84, and a release 86. The override chamber 83*h,w* may be formed radially between the barrel sleeve 75*s* and the mandrel main section 60*m* and longitudinally between the actuation 75*a* and balance 75*b* pistons. The override piston 81 may be disposed in the override chamber 83*h,w* may divide the chamber into an upper portion 83*h* and a lower portion 83*w*. Each set of ports 82*u,b* may be formed through a wall of the mandrel main portion 60*m* and may provide fluid communication between the respective chamber portion 83*h,w* and a bore of the setting tool 52.

The override piston 81 may be longitudinally movable relative to the housing 65 and the mandrel 62 between an upper position (FIG. 3B) and a lower position (partially lowered position shown). The upper position may be adjustable by the lower standoff 74*b* disposed between a lower face of the actuation piston 75*a* and an upper face of the override piston 81. The override piston 81 may have an upper enlarged portion 81*u*, a lower reduced portion 81*b*, and a shoulder formed between the two portions. An interface between the override piston upper portion 81*u* and the barrel sleeve 75*s* and an interface between the override piston upper portion 81 and the main mandrel section 60*m* may each be isolated by one or more (two shown) seals. The override piston upper portion 81*u* may also carry an inner slide bearing 71*b* for facilitating longitudinal movement relative to the mandrel 60 and an outer slide bearing for facilitating longitudinal movement relative to the barrel 75. The lower reduced portion 81*b* may have one or more (two shown) slots formed therethrough for ensuring that the lower reduced portion does not unintentionally separate the lower override chamber portion 83*w*.

Should the electronics package 66 and/or the actuator 69 fail to set the liner hanger 15*s*, an override plug, such as ball 87, may be pumped to the setting tool 52 and received by the seat 84. The seat 84 may be disposed in the main mandrel section 60*m* between the upper 82*u* and lower 82*b* ports. The seat 84 may be a collet having an upper base portion and fingers extending from the base portion to a lower end thereof. A lug may be formed at a lower end of each finger. Collectively, the lugs may protrude into the mandrel bore for receiving the ball 87. The fingers may operate as cantilever springs movable between a retracted position (shown) and an extended position (not shown). The fingers may be naturally biased toward the extended position.

The seat base portion may be releasably connected to the main mandrel section 60*m*, such as by a shearable fastener 85. A threshold pressure necessary to fracture the fastener 85 may correspond to the threshold pressure required to set the liner hanger 15*h*, such as being slightly greater than. Once the seat 84 has been released from the mandrel 60, the seat may slide downward relative to the mandrel until the collet fingers reach the release 86. The release 86 may be a groove formed in an inner surface of the main mandrel section 60*m*. Upon reaching the release 86, the collet fingers may snap to the extended position, thereby releasing the ball 87.

The ball 87 may be pumped to the seat 84 using the conditioner 100. Once the ball 87 seats, continued pumping of the conditioner 100 into the LDA bore may increase pressure 88 in the chamber upper portion 83*h* relative to the lower portion 83*w* and push the override piston 81 into engagement with the balance piston 75*b*. Pumping may continue until the shearable fastener 15*y* fractures and the liner hanger 15*h* is set against the casing 25. The ball 87 may then be released and operation of the LDA 9*d* may continue.

Alternatively, the setting tool 52 may be used to drive an expander through an expandable liner hanger. Alternatively, the setting tool 52 may be used to hang a casing string from a subsea wellhead. Alternatively, the liner string 15 may be hung from another liner string instead of the casing string 25.

In one embodiment, a setting tool for hanging a tubular string includes: a mandrel having an upper portion and a lower portion for extending into the tubular string; a housing connected to the mandrel upper portion; a bonnet for receiving an upper end of the tubular string, disposed along the mandrel, and linked to the housing; a hydraulic setting actuator for stroking the bonnet relative to the mandrel and the housing, thereby setting a hanger of the tubular string; a hydraulic reservoir in fluid communication with an inlet of the setting actuator; an actuation chamber in fluid communication with an outlet of the setting actuator; a balance chamber in fluid communication with the hydraulic reservoir; and a piston in fluid communication with the outlet of the setting actuator and the balance chamber.

In one or more embodiments disclosed herein, the setting tool also includes an electronics package in communication with the setting actuator for operating the setting actuator in response to receiving a first command signal.

In one or more embodiments disclosed herein, the setting tool also includes an antenna disposed in the mandrel and in communication with a bore of the setting tool for receiving the first command signal.

In one or more embodiments disclosed herein, the setting tool also includes a bypass passage and a shutoff valve disposed in the bypass passage for selectively providing fluid communication between the actuation chamber and the hydraulic reservoir.

In one or more embodiments disclosed herein, the setting tool also includes a catch sleeve extending into the balance chamber and linking the bonnet to the housing.

In one or more embodiments disclosed herein, the piston is a barrel having an actuation piston, a balance piston, and a sleeve connecting the actuation piston and the balance piston.

In one or more embodiments disclosed herein, the setting tool also includes an override piston disposed in the barrel and dividing a bore of the barrel into an upper override chamber and a lower override chamber, wherein the mandrel has an upper and lower ports, each port providing fluid communication between a bore of the setting tool and the respective override chamber.

In one or more embodiments disclosed herein, a deployment assembly for hanging a tubular string from a liner string, casing string, or wellhead, includes a setting tool operable to set the hanger of the tubular string; and a running tool operable to longitudinally and torsionally connect the tubular string to an upper portion of the deployment assembly and comprising a lock actuator and an electronics package in communication with the lock actuator for operating the lock actuator in response to receiving a second command signal.

In one or more embodiments disclosed herein, the running tool also includes a tubular body connectable to the mandrel; a latch for releasably connecting the tubular string to the tubular body and comprising: a longitudinal fastener for engaging a longitudinal profile of the tubular string; and a torsional fastener for engaging a torsional profile of the tubular string; a lock movable between a locked position and an unlocked position by the lock actuator, the lock keeping the latch engaged in the locked position; and a clutch for selectively torsionally connecting the torsional fastener to the tubular body, and the setting tool is operable as a slip joint allowing relative longitudinal movement between the mandrel and the tubular string in order to operate the clutch.

In one or more embodiments disclosed herein, the deployment assembly also includes a plug release system connected to the running tool and comprising: a wiper plug; a plug release actuator; and an electronics package in communication with the plug release actuator for operating the plug release actuator and releasing the wiper plug in response to receiving a third command signal.

In one or more embodiments disclosed herein, a system for hanging a tubular string from a liner string, casing string, or wellhead, includes a deployment assembly; and a tubular string comprising: a polished bore receptacle having a latch profile for engagement with the running tool; a setting sleeve for engagement with the bonnet; a packer connected to the setting sleeve; a hanger having an upper portion connected to the packer and a lower portion connected to the polished bore receptacle; a shearable fastener connecting the upper portion of the hanger to the polished bore receptacle; and a releasable slip joint connecting an upper portion of the packer to the polished bore receptacle.

In another embodiment, a method of deploying a tubular string includes running the tubular string into a wellbore using a deployment string and a deployment assembly, wherein the deployment assembly comprises a setting tool closing an upper end of the tubular string with a bonnet engaged with a setting sleeve of the tubular string; setting a hanger of the tubular string by operating a setting actuator with the setting tool to push the bonnet and the setting sleeve, after setting the hanger, sending a second command signal to a running tool that is longitudinally and torsionally fastening the tubular string to the deployment string, thereby unlocking or releasing the running tool; after sending the second command signal, raising the setting tool from the tubular string, thereby extending a latch of the setting tool against the upper end; and after raising the setting tool, setting weight on the latch and the upper end, thereby setting a packer of the tubular string.

In one or more embodiments disclosed herein, the setting the hanger of the tubular string comprises sending a first command signal to the setting tool.

In one or more embodiments disclosed herein, the first command signal is sent by pumping a wireless identification tag through the deployment string to the setting tool.

In one or more embodiments disclosed herein, the method further comprises releasing the running tool by lowering and then rotating the deployment string, and the bonnet and the setting sleeve remain stationery while lowering the deployment string.

In one or more embodiments disclosed herein, the method of claim also includes pumping a cement slurry into the deployment string; and driving the cement slurry through the deployment string and the deployment assembly while sending a third command signal to a plug release system of the deployment assembly, wherein the plug release system releases a wiper plug in response to receiving the third command signal.

In one or more embodiments disclosed herein, the cement slurry is driven by a following with a dart and the third command signal is sent by the dart having an embedded wireless identification tag.

In another embodiment, a method of operating a liner deployment assembly includes advancing a tubular string into a wellbore; setting a liner hanger in the tubular string;

after the setting the liner hanger, releasing a running tool of the liner deployment assembly, wherein releasing the running tool comprises sending a second command signal to the running tool; after the releasing the running tool, pumping cement down the tubular string; and after the pumping cement, setting a packer in the tubular string.

In one or more embodiments disclosed herein, the setting the liner hanger comprises sending a first command signal to a setting tool.

In one or more embodiments disclosed herein, sending the first command signal comprises: sending a first tag down the tubular string; and transmitting the first command signal from the first tag to an antenna of the setting tool.

In one or more embodiments disclosed herein, sending the first command signal further comprises, after the sending the first tag and before the transmitting the first command signal, receiving an activation signal at the first tag from the antenna of the setting tool.

In one or more embodiments disclosed herein, the first tag is a radio frequency identification tag, and the first command signal is a wireless command signal.

In one or more embodiments disclosed herein, the first tag is at least one of a passive tag, a wireless identification and sensing platform radio frequency identification tag, and an active tag.

In one or more embodiments disclosed herein, the method also includes, after the setting the liner hanger and before the releasing the running tool, confirming the setting of the liner hanger.

In one or more embodiments disclosed herein, the confirming the setting of the liner hanger comprises pulling on drill pipe connected to the tubular string.

In one or more embodiments disclosed herein, sending the second command signal comprises: sending a second tag down the tubular string; and transmitting the second command signal from the second tag to an antenna of the running tool.

In one or more embodiments disclosed herein, sending the second command signal further comprises, after the sending the second tag and before the transmitting the second command signal, receiving an activation signal at the second tag from the antenna of the running tool.

In one or more embodiments disclosed herein, the second tag is a radio frequency identification tag, and the second command signal is a wireless command signal.

In one or more embodiments disclosed herein, the second tag is at least one of a passive tag, a wireless identification and sensing platform radio frequency identification tag, and an active tag.

In one or more embodiments disclosed herein, the method also includes, after the releasing the running tool and before the pumping cement, confirming the releasing of the running tool.

In one or more embodiments disclosed herein, the confirming the releasing of the running tool comprises raising and lowering the tubular string.

In one or more embodiments disclosed herein, the setting the packer comprises sending a third command signal to a plug release system.

In one or more embodiments disclosed herein, sending the third command signal comprises: sending a third tag down the tubular string; and transmitting the third command signal from the third tag to an antenna of the plug release system.

In one or more embodiments disclosed herein, sending the third command signal further comprises, after the sending the third tag and before the transmitting the third command signal, receiving an activation signal at the third tag from the antenna of the plug release system.

In one or more embodiments disclosed herein, the third tag is a radio frequency identification tag, and the third command signal is a wireless command signal.

In one or more embodiments disclosed herein, the third tag is at least one of a passive tag, a wireless identification and sensing platform radio frequency identification tag, and an active tag.

In one or more embodiments disclosed herein, the method also includes, after the transmitting the third command signal, confirming landing of a dart in which the third tag is embedded.

In one or more embodiments disclosed herein, the confirming the landing of the dart comprises waiting a preset period of time.

In one or more embodiments disclosed herein, the setting the packer further comprises, after the sending the third command signal: raising the tubular string; and exerting weight on the liner deployment assembly.

While the foregoing is directed to embodiments of the present disclosure, other and further embodiments of the disclosure may be devised without departing from the basic scope thereof, and the scope of the invention is determined by the claims that follow.

The invention claimed is:

1. A setting tool for hanging a tubular string, comprising:

a mandrel having an upper portion and a lower portion for extending into the tubular string;

a housing connected to the mandrel upper portion;

a bonnet for receiving an upper end of the tubular string, disposed along the mandrel, and linked to the housing;

a hydraulic setting actuator for stroking the bonnet relative to the mandrel and the housing, thereby setting a hanger of the tubular string;

a hydraulic reservoir in fluid communication with an inlet of the setting actuator;

an actuation chamber in fluid communication with an outlet of the setting actuator;

a balance chamber in fluid communication with the hydraulic reservoir; and a piston in fluid communication with the outlet of the setting actuator and the balance chamber.

2. The setting tool of claim 1, further comprising:

an electronics package in communication with the setting actuator for operating the setting actuator in response to receiving a first command signal; and an antenna disposed in the mandrel and in communication with a bore of the setting tool for receiving the first command signal.

3. The setting tool of claim 1, wherein:

the piston is a barrel having an actuation piston, a balance piston, and a sleeve connecting the actuation piston and the balance piston;

the setting tool further comprises an override piston disposed in the barrel and dividing a bore of the barrel into an upper override chamber and a lower override chamber; and the mandrel has an upper and lower ports, each port providing fluid communication between a bore of the setting tool and the respective override chamber.

4. A deployment assembly for hanging a tubular string from a liner string, casing string, or wellhead, comprising:

the setting tool of claim 1 operable to set the hanger of the tubular string; and a running tool operable to longitudinally and torsionally connect the tubular string to an upper portion of the deployment assembly and comprising a lock actuator and an electronics package in communication with the lock actuator for operating the lock actuator in response to receiving a second command signal.

5. The deployment assembly of claim 4, wherein:

the running tool further comprises:

a tubular body connectable to the mandrel;

a latch for releasably connecting the tubular string to the tubular body and comprising:

a longitudinal fastener for engaging a longitudinal profile of the tubular string; and a torsional fastener for engaging a torsional profile of the tubular string;

a lock movable between a locked position and an unlocked position by the lock actuator, the lock keeping the latch engaged in the locked position; and a clutch for selectively torsionally connecting the torsional fastener to the tubular body, and the setting tool is operable as a slip joint allowing relative longitudinal movement between the mandrel and the tubular string in order to operate the clutch.

6. The deployment assembly of claim 4, further comprising a plug release system connected to the running tool and comprising:

a wiper plug;

a plug release actuator; and an electronics package in communication with the plug release actuator for operating the plug release actuator and releasing the wiper plug in response to receiving a third command signal.

7. A system for hanging a tubular string from a liner string, casing string, or wellhead, comprising:

the deployment assembly of claim 4; and the tubular string comprising:

a polished bore receptacle having a latch profile for engagement with the running tool;

a setting sleeve for engagement with the bonnet;

a packer connected to the setting sleeve;

a hanger having an upper portion connected to the packer and a lower portion connected to the polished bore receptacle;

a shearable fastener connecting the upper portion of the hanger to the polished bore receptacle; and a releasable slip joint connecting an upper portion of the packer to the polished bore receptacle.

8. A method of deploying a tubular string, comprising:

running the tubular string into a wellbore using a deployment string and a deployment assembly, wherein the deployment assembly comprises a setting tool closing an upper end of the tubular string with a bonnet engaged with a setting sleeve of the tubular string;

setting a hanger of the tubular string by operating a setting actuator with the setting tool to push the bonnet and the setting sleeve, after setting the hanger, sending a second command signal to a running tool that is longitudinally and torsionally fastening the tubular string to the deployment string, thereby unlocking or releasing the running tool;

after sending the second command signal, raising the setting tool from the tubular string, thereby extending a latch of the setting tool against the upper end; and after raising the setting tool, setting weight on the latch and the upper end, thereby setting a packer of the tubular string.

9. The method of claim 8, wherein the setting the hanger of the tubular string comprises sending a first command signal to the setting tool.

10. The method of claim 9, wherein the first command signal is sent by pumping a wireless identification tag through the deployment string to the setting tool.

11. The method of claim 8, further comprising:

pumping a cement slurry into the deployment string; and driving the cement slurry through the deployment string and the deployment assembly while sending a third command signal to a plug release system of the deployment assembly, wherein the plug release system releases a wiper plug in response to receiving the third command signal.

12. The method of claim 11, wherein the cement slurry is driven by a following with a dart and the third command signal is sent by the dart having an embedded wireless identification tag.

13. A method of operating a liner deployment assembly comprising:

advancing a tubular string into a wellbore;

setting a liner hanger in the tubular string;

after the setting the liner hanger, releasing a running tool of the liner deployment assembly, wherein releasing the running tool comprises sending a second command signal to the running tool;

after the releasing the running tool, pumping cement down the tubular string; and after the pumping cement, setting a packer in the tubular string, wherein the setting the liner hanger comprises sending a first command signal to a setting tool, and wherein sending the first command signal comprises:

sending a first tag down the tubular string;

after the sending the first tag, receiving an activation signal at the first tag from the antenna of the setting tool; and after the receiving the activation signal, transmitting the first command signal from the first tag to an antenna of the setting tool.

14. A method of operating a liner deployment assembly comprising:

advancing a tubular string into a wellbore;

setting a liner hanger in the tubular string;

after the setting the liner hanger, releasing a running tool of the liner deployment assembly, wherein releasing the running tool comprises sending a second command signal to the running tool;

after the releasing the running tool, pumping cement down the tubular string; and after the pumping cement, setting a packer in the tubular string, wherein sending the second command signal comprises:

sending a second tag down the tubular string;

transmitting the second command signal from the second tag to an antenna of the running tool; and after the sending the second tag and before the transmitting the second command signal, receiving an activation signal at the second tag from the antenna of the running tool.

15. A method of operating a liner deployment assembly comprising:

advancing a tubular string into a wellbore;

setting a liner hanger in the tubular string;

after the setting the liner hanger, releasing a running tool of the liner deployment assembly, wherein releasing the running tool comprises sending a second command signal to the running tool;

after the releasing the running tool, pumping cement down the tubular string; and after the pumping cement, setting a packer in the tubular string; and sending a third command signal to a plug release system by:

sending a third tag down the tubular string; and transmitting the third command signal from the third tag to an antenna of the plug release system.

16. The method of claim 15, wherein sending the third command signal further comprises, after the sending the third tag and before the transmitting the third command signal, receiving an activation signal at the third tag from the antenna of the plug release system.

17. The method of claim 15, wherein the setting the packer comprises:

raising the tubular string; and exerting weight on the liner deployment assembly.

18. A method of operating a liner deployment assembly comprising:

advancing a tubular string into a wellbore;

setting a liner hanger in the tubular string;

after the setting the liner hanger, releasing a running tool of the liner deployment assembly, wherein releasing the running tool comprises sending a second command signal to the running tool;

confirming release of the running tool by raising and lowering the tubular string;

after confirming release of the running tool, pumping cement down the tubular string; and after the pumping cement, setting a packer in the tubular string.

19. The method of claim 18, wherein the setting the liner hanger comprises sending a first command signal to a setting tool.

20. The method of claim 19, wherein sending the first command signal comprises:

sending a first tag down the tubular string; and transmitting the first command signal from the first tag to an antenna of the setting tool.

* * * * *